US005911539A

United States Patent [19]

Egan et al.

[11] Patent Number: 5,911,539

[45] Date of Patent: Jun. 15, 1999

[54] INTERCONNECTED BLOCK SYSTEM

[75] Inventors: Philip D. Egan, Atlanta, Ga.; Steve Maher, Orlando, Fla.; Mark Wayne, Alpharetta, Ga.

[73] Assignee: The Tensar Corporation, Atlanta, Ga.

[21] Appl. No.: 08/763,948

[22] Filed: Dec. 11, 1996

Related U.S. Application Data

[63] Continuation-in-part of application No. 08/730,600, Oct. 15, 1996, which is a continuation-in-part of application No. 08/677,189, Jul. 6, 1996, abandoned.

[51] Int. Cl.[6] ..... E02B 3/14

[52] U.S. Cl. ..... 405/20; 405/16

[58] Field of Search ..... 405/15, 16, 17, 405/19, 20, 258; 52/596, 597, 605, 606, 607

[56] References Cited

U.S. PATENT DOCUMENTS

| | | | |
|---|---|---|---|
| 869,566 | 10/1907 | Hawkes . | |
| 1,071,091 | 8/1913 | Rogers . | |
| 2,092,183 | 9/1937 | Rehfeld . | |
| 2,876,628 | 3/1959 | Dixon, Jr. | 405/20 |
| 3,096,621 | 7/1963 | Danel | 405/16 |
| 3,597,928 | 8/1971 | Pilaar . | |
| 3,601,015 | 8/1971 | Kilstofte . | |
| 3,702,093 | 11/1972 | Van de Loock et al. . | |
| 3,922,865 | 12/1975 | Nijdam . | |
| 4,370,075 | 1/1983 | Scales . | |
| 4,374,798 | 2/1983 | Mercer . | |
| 4,417,828 | 11/1983 | de Winter . | |
| 4,436,447 | 3/1984 | Crowe | 405/16 |
| 4,449,847 | 5/1984 | Scales et al. . | |
| 4,502,815 | 3/1985 | Scales et al. . | |
| 4,530,622 | 7/1985 | Mercer . | |
| 4,726,708 | 2/1988 | Papetti . | |
| 4,815,892 | 3/1989 | Martin . | |
| 5,108,222 | 4/1992 | Jansson et al. . | |
| 5,273,804 | 12/1993 | Brian et al. . | |
| 5,342,141 | 8/1994 | Close . | |
| 5,540,525 | 7/1996 | Miller et al. . | |
| 5,595,460 | 1/1997 | Miller et al. . | |

FOREIGN PATENT DOCUMENTS

| | | | |
|---|---|---|---|
| 0608036 | 7/1994 | European Pat. Off. . | |
| 2123523 | 11/1972 | Germany | 405/20 |

*Primary Examiner*—Tamara Graysay
*Assistant Examiner*—Frederick L. Lagman
*Attorney, Agent, or Firm*—Jacobson, Price, Holman & Stern, PLLC

[57] ABSTRACT

An interconnected block system including a plurality of staggered rows of block members formed of concrete or the like secured to the upper surface only of an underlying, interconnecting, grid-like, matrix sheet. In one embodiment, a plurality of connector elements are connected to the matrix material preferably by bodkin connections to form one or a multiplicity of openings or apertures above the upper surface of the matrix sheet for reception of the block-forming material. The block members are cast on top of the matrix sheet material to capture the connector elements which provides a mechanical interlock between the block member and the matrix. The matrix sheet material preferably includes a layer of geotextile bonded on an opposite side from the block members. An alternate embodiment provides a strip or mat to underly the matrix sheet with a plurality of projections upstanding therefrom and passing through the matrix sheet. Free end portions of the projections are configured to retain block-forming material cast to surround the projections. Multiple layers of interconnected blocks may be made without waiting for the concrete to set by using preformed mold elements which are left in place in the final product and which act to support superimposed layers as they are cast. A sleeve may be secured to a leading edge of the matrix sheet to receive and retain a sand-filled tube or the like to prevent lifting of the matrix sheet by wave action or the like. An alternative block includes slots extending from an upper surface to a lower surface for engagement with connector devices securing a sheet material matrix to the lower surface and optionally a sheet material matrix to the upper surface of the block.

33 Claims, 18 Drawing Sheets

INTERCONNECTED BLOCK SYSTEM

This application is a continuation-in-part of application Ser. No. 08/730,600, filed Oct. 15, 1996, which is a continuation-in-part of application Ser. No. 08/677,189, filed Jul. 9, 1996, now abandoned, the subject matter of each of which are incorporated herein in their entirety by reference.

FIELD OF THE INVENTION

This invention relates to an interconnected block system including concrete or concrete-like blocks cast and mechanically interconnected on top of an underlying matrix formed by a grid-like geosynthetic material or geocomposite which may include a sorbent material to remove contaminants from environmental water. The invention also includes means for splicing individual sections of the matrix material as well as means and techniques for lifting, placing and securing large sections of the matrix for use, inter alia, as revetments, pavements, channel linings, and other special lining systems in erosion control, waste containment and paving applications. A second layer of grid-like geosynthetic material may be mechanically secured on top of the interconnected block system. The interstitial spaces between the blocks, or the pockets formed between the blocks and the upper and lower sheet materials, may optionally include shotcrete or sod, aggregate fill materials, sorbent particles, and/or pieces of geonet adapted to slow runoff and help trap sediment. The interconnected block system can be combined with a sand filled tube to prevent lifting of a leading edge of a section of the grid-like geosynthetic material or geocomposite.

BACKGROUND OF THE INVENTION

A major application of the interconnected block system of the instant invention is to minimize or prevent shoreline erosion from fast flowing water. Such erosion is commonly seen in ocean or seaside environments where wave action can cause significant damage. Similar problems exist where water flowing quickly along a river produces erosion of the river banks. Revetments in the nature of an interconnected block system according to this invention provide excellent erosion protection in such environments while offering other advantages to be discussed hereinafter.

Another area where interconnected block systems, sometimes referred to as geomats or geomattresses, find utility is the capping of dredge spoil domes. Harbors throughout the United States require periodic dredging to maintain sufficient draft depth for shipping. The dredge spoil produced by this operation is loaded into bottom dump barges and transported out to sea to underwater dredge disposal sites which have been identified by the U.S. Army Corps of Engineers.

At the disposal site the dredge spoil material is simply dumped from the barge and allowed to settle to the bottom of the sea at a depth ranging from 150 to 200 feet. This procedure creates large domes of dredge spoil material which range from 1000 to 2300 feet in diameter. The dredge spoil material oftentimes includes contaminated material which is potentially harmful to the environment. A solution is presently being sought to develop ways of capping these domes to prevent migration of the contaminated material to the surrounding ocean beds and water.

One proposed solution for this problem is the use of a concrete mass to cap the domes of contaminated material. There is currently an interconnected concrete block revetment system on the market as described in U.S. Pat. No. 4,370,075, the subject matter of which is incorporated herein in its entirety by reference. In this system, a plurality of individual concrete blocks are cast with horizontally and vertically oriented holes. After the blocks have cured, they are then moved to an assembly area where they are arranged in a selected configuration by hand and steel cables are threaded through the horizontally oriented holes to tie the entire panel together. The panels may then be lifted from the ends of the steel cables by a sling system and positioned for use. The pre-cast vertically oriented holes may be filled with soil to allow for revegetation.

The cables passing through the horizontally oriented preformed holes permit relative movement of the individual blocks. Repeated abrasion resulting from wave action may eventually cause failure of the cables. While the primary function of the cable system is for lifting and placement of the interconnected blocks, destruction of this matrix is believed to significantly reduce the effectiveness of the revetment.

An alternate approach is disclosed in U.S. Pat. Nos. 4,449,847 and 4,502,815, the subject matters of which are also incorporated herein in their entirety by reference. Here, a high strength fabric bag is positioned for use and pumped full of concrete grout. This system is effectively limited to revetment applications and cannot be economically placed in deep water.

Each of these prior art techniques either require placement in situ or by lifting small pre-assembled units. As a result, the size of such installations is relatively small, on the order of, perhaps, forty feet long by about eight feet wide, limiting the use of these systems in efficiently and effectively capping the domes of contaminated dredge material.

More recently, the use of an articulated mat comprising a geogrid embedded in discrete concrete castings has been described in U.S. Pat. No. 5,108,222, the subject matter of which is incorporated herein in its entirety by reference. This system is believed to be severely limited due to the strength of the proposed interconnecting matrix.

An improved approach is disclosed in copending, commonly assigned U.S. patent application Ser. No. 08/455,684 filed May 31, 1995, the subject matter of which is also incorporated herein in its entirety by reference. In the preferred embodiment of that application, a geomattress is formed by placing sections of a uniaxially oriented grid-like sheet material across a plurality of spaced, staggered forms in which the bottom portions of concrete panels have been cast. The uniaxially oriented material includes thickened bars interconnected by oriented strands and the upper portions of the panels are cast to secure at least one such bar to each panel thereby providing a strengthened articulated matrix for interconnecting and supporting the concrete panels during lifting, placement and use of the geomattress.

The aforementioned techniques for producing articulated mats or geomattresses require the concrete blocks to be cast in two separate steps in order for portions of the concrete to pass through the openings of the grid-like matrix. Such a process is time consuming and difficult to accomplish at a construction site. Accordingly, the geomattress must first be formed, then lifted, and transported to a final destination.

Additionally, the need to cast the concrete blocks on both sides of the grid-like matrix so the concrete can pass through the openings and embed the grid material precludes the use of a geocomposite having a geotextile facing adapted for contact with the underlying soil or base material, an important structural characteristic to provide erosion protection, drainage, filtration and separation. Even separately laying a geotextile beneath an interconnected block system of the prior art, a time consuming and labor intensive process, does not adequately and uniformly secure the geotextile in place, limiting the effectiveness of such systems for many applications.

Sorbent material may be used when dealing with contaminated sediments in subaqueous in-situ capping. One of the considerations in designing a cap is the chemical isolation of the contaminated layer, i.e., the design must address the potential for movement of porewater or molecular diffusion from the contaminated layer upward into the cap. Adsorptive materials can be highly effective in reducing the effects of advection and diffusion. This is particularly applicable when groundwater flows up through the bed, such as in a gaining stream, or where consolidation of the contaminated sediment layer is expected to express porewater. Placing the sorbent materials in a stabilized manner in subaqueous conditions is problematic and prior art geomattress constructions have not be useful in efficiently dealing with this problem.

Thus, the prior art interconnected block systems each have limitations in manufacture or use, depending on the particular application for which the products are intended.

SUMMARY OF THE INVENTION

It is a primary object of the present invention to provide an interconnected block system for diverse applications including erosion control, waste containment and decontamination, and paving, which is free of the foregoing and other disadvantages attendant to prior art approaches currently in use or proposed for use.

Another object of this invention is the provision of an interconnected block revetment system which is relatively inexpensive to manufacture and use, yet highly versatile and readily adapted to different end uses.

Still a further object of the instant inventive concepts is to provide a method for making an interconnected block system which can be cast in-place, or on-site, or at an off-site prefabrication facility.

Another object of this invention is the provision of an interconnected block system including means for splicing or interconnecting a multiplicity of individual sections to produce an expanded mat for large site applications.

It is still a further object of this invention to provide a simple and inexpensive lifting loop that can be readily attached to a section of the interconnected block system of this invention at substantially any position to enable the same to be lifted and placed in position by a crane or other such heavy equipment.

Another object of this invention is to utilize the interstices or spaces between the blocks of the interconnected block system to carry materials, such as shotcrete or sod, or even small portions of a geonet or the like capable of improving the erosion control characteristics of the product.

A related feature of this invention is to provide both an underlying and an overlying sheet material matrix integrating the spaced concrete blocks, producing not only a stronger system, but defining pockets intermediate to the blocks which can be used to carry an aggregate such as fiber or stone fill material, the small geonet baffles, or, in an environment where contaminants are present, a sorbent material such as activated carbon particles or the like, capable of absorbing or adsorbing such contaminants.

It is still another object of the present invention to provide a means to secure a sand-filled tube to a leading edge of a grid-like material to which blocks have been secured to anchor the leading edge against uplifting forces, such as wave action.

More specifically, the primary objectives of this invention are realized by a geomattress or the like in which the interconnecting matrix for a plurality of blocks formed of concrete or the like may be formed of a grid-like material alone, such as an integrally formed uniaxially or biaxially oriented structural geogrid or a bonded composite open mesh structural textile, or a geocomposite comprising such a grid-like material bonded directly to a geotextile or a drainage net material. In this manner, the grid-like material may perform certain functions, including configuration or spacing of the blocks, a durable interconnection of the blocks longitudinally and laterally while providing a polymeric carriage for lifting and placement of the mat of blocks, and the geotextile or drainage net may perform other functions, including separation, filtration and improved erosion control. The geotextile may even include a sorbent material for removing contaminants from the ambient environment.

The use of a geocomposite matrix integral to the system provides the unique capacity to maintain intimate contact of a geotextile with the underlying soil. Moreover, the flexural rigidity of the geocomposite matrix insures this intimate contact, even between the blocks, to provide excellent erosion protection, drainage, filtration and separation.

Shotcrete, hydroseeded dirt or staked sod may be provided between adjacent blocks in the system. In addition, a further grid-like material or a geotextile may be secured across and on top of a plurality of blocks in an interconnected block system according to this invention so as to further integrate the blocks in the system and, if desired, provide pockets in which an anchoring material such as fiber or stone fill, or even sorbent particles may be carried. Alternatively, or in addition to the fill material between the blocks, a drainage net may be held in place between adjacent blocks by the top layer of sheet material so as to form a baffle between blocks to slow runoff and trap sediment.

In the broadest sense, many important objects of this invention are achieved by various unique mechanical interconnections discussed hereinafter which enable a plurality of spaced blocks formed of concrete or the like to be effectively secured to only one side of an underlying sheet or matrix, whether the interconnecting matrix is an integral biaxially or uniaxially oriented structural geogrid or a bonded composite open mesh structural textile alone, or such a grid-like material uniformly bonded to a geotextile or a drainage net material for improved structural and functional properties.

In addition, dependent on the type of block used, connection may be made to both underlying and overlying sheets of such matrix material to enhance the integration of the block system and provide pockets in the interstices between the blocks to receive and retain any of a variety of materials for specific applications.

According to the initial embodiments of this invention, one or more upstanding connector elements are formed on the upper surface of an interconnecting matrix, each of which defines a cavity or reservoir, or a grid-like array of apertures, or a combination of such elements, for reception of block-forming material such as concrete of the like to thereby mechanically interlock a plurality of blocks cast in a pre-selected pattern on the surface of the matrix.

As will be discussed in more detail hereinafter, the connector elements are preferably in the form of small inverted U- or V-shaped "sleds", or hoops, each of which is fixedly secured to the interconnecting matrix to extend upwardly from one face of the matrix. The connector elements themselves are preferably formed of a grid-like material such as short sections of a uniaxially or biaxially oriented integral structural geogrid or a bonded composite open mesh structural textile. Such materials comprise openings or apertures defined by their interconnected strands extending at an angle to, and spaced from, the upper surface of the matrix sheet through which the cast block-forming material may pass to secure the resultant blocks to the underlying interconnecting matrix.

Further, the very nature of the "sled" or hoop construction, even if formed of imperforate sheet material, defines an opening or cavity which extends generally parallel to the upper surface of the matrix sheet and functions as a reservoir for reception of block-forming material to integrate the cast blocks with the interconnecting matrix in a secure manner.

Alternatively, the connector elements may take the form of elongated strips or mats having a plurality of fingers extending from one surface thereof. The free ends of the fingers may include serrations, barbs, balls, hooks, or even openings, so that, when the fingers project through a matrix to an extent limited by the strips contacting the undersurface of the matrix, the free ends of the fingers are captured within a block-forming material cast on the upper surface of the matrix to secure the thus-formed blocks to the matrix material.

Another alternative form of connector elements that may be used are comb-like connector devices having a plurality of fingers extending from one surface thereof, of the type disclosed, for example, in U.S. Pat. No. 5,540,525, the subject matter of which is incorporated herein in its entirety by reference. The fingers of such connector devices frictionally engage sidewalls of slots defined in the block to retain a matrix below the block so that it is not necessary to cast the blocks in situ as with the previous embodiment. In fact the blocks may be preformed with appropriate slots in one surface thereof or slots may be provided in both surfaces of the blocks for securing matrices from above and below the blocks to better interconnect the blocks in a preselected pattern and to define pockets intermediate to the blocks for reception of various materials as discussed herein.

Additional anchoring of the mattress to an underlying base material may be provided by bolts passing through centrally located stepped aperture in selected blocks of the interconnected block system of this invention. For example, such a bolt may be anchored below ground level as in the engineered earth anchors available from Foresight® Products Inc. of Commerce City, Colo., under the name MANTA RAY®. The opposite end of the bolts may include a washer and a lock nut which seat in recesses preformed in the upper surfaces of the blocks.

The term "grid-like sheet material" as used herein and the appended claims is to be understood as encompassing any continuous sheet material having one or more apertures formed therein in any conventional manner. Depending upon the particular application, preferred materials for either the underlying matrix of the interconnected block system of the instant invention, the overlying matrix of the interconnected block system of the instant invention, or the connector elements or "sleds" themselves may be uniaxially or biaxially oriented integral structural geogrids or bonded composite open mesh structural textiles. The description of preferred forms of both such materials are found in co-pending, commonly assigned U.S. patent application Ser. No. 08/643,182 filed May 9, 1996, the subject matter of which is incorporated herein in its entirety by reference. The preferred form of uniaxially or biaxially oriented integral structural geogrids are commercially available from The Tensar Corporation of Atlanta, Ga. ("Tensar") and are made by the process disclosed in U.S. Pat. No. 4,374,798, the subject matter of which is also incorporated herein in its entirety by reference.

A high strength integral geogrid may be formed by stretching an apertured plastic sheet material. Utilizing the uniaxial techniques, a multiplicity of molecularly-oriented elongated strands and transversely extending bars which are substantially unoriented or less-oriented than the strands are formed in a sheet of high density polyethylene, although other polymer materials may be used in lieu thereof. The strands and bars together define a multiplicity of grid openings. With biaxial stretching, the bars are also formed into oriented strands.

As indicated, particularly where high strength is required, the preferred grid-like sheet material is a uniaxially-oriented geogrid material. However, biaxial geogrids or grid materials that have been made by different techniques such as woven, knitted or netted grid materials formed of various polymers including the polyolefins, polyamides, polyesters and the like or fiberglass, may be used. In fact, any grid-like sheet materials, including steel (welded wire) grids capable of being secured to concrete blocks according to the instant invention in the manner disclosed herein are suitable. Also, for most applications, bonded composite open mesh structural textiles, such as disclosed in the aforementioned application Ser. No. 08/643,182 may be useful as the underlying or overlying, interconnecting matrix sheet material, or for the formation of the connector elements.

It is to be understood that, while reference is made throughout to the preferred form of the interconnecting matrix sheet as "grid-like", the matrix material may have solid portions, particularly in the gaps intermediate the concrete blocks. In fact, when producing an interconnected block system using connector elements comprising strips of material or comb-like devices with a plurality of upstanding fingers which protrude through the matrix, the matrix may be substantially imperforate except for openings through which the fingers of the connector elements may pass. These openings may be pre-formed or produced by the penetration of the fingers, if the fingers of the connector elements are sufficiently rigid. Thus, the term "grid-like" is intended to encompass such a matrix as well.

Even with the sled-like form of connector element discussed above, matrix materials which are partially or entirely imperforate may be used, so long as the connectors can be secured to the matrix so as to extend from one surface thereof and define openings or reservoirs for reception of the block-forming material.

As discussed, with each of the embodiments of this invention, the concrete blocks are secured to only one side of the underlying interconnecting sheet material. In the initially discussed embodiments, one or more small pieces, preferably of grid-like sheet material, of an overall length and width less than the to-be-formed block are secured to the matrix to form the aforementioned "sleds" or hoops. A preferred connection between these elements is referred to as a "bodkin" and is formed by utilizing a grid-like material for the connector elements and by transversely bending strands of the connector-forming grid-like sheet material to form loops which are passed through the openings between the strands of the underlying grid-like sheet material forming the matrix or the upper layer of the matrix, and then engaging a connecting member or rod, such as ⅜ inch HDPE bodkin connector bar or the like, through the loops to prevent the loops from being withdrawn. Such a connection is well known and shown in U.S. Pat. No. 4,530,622, the subject matter of which is incorporated herein in its entirety by reference. In this manner, opposite ends or edge portions of the connector-forming material may be anchored to the elongated grid-like matrix to project from one side thereof in a U- or V-shaped configuration.

Alternatively, a small piece of grid-like sheet material or the like can be formed into a circular hoop and connected by a single bodkin connector bar to the underlying grid-like sheet material of the matrix as discussed in more detail hereinafter.

With this type embodiment, a casting form is then placed around the projecting portion of each of the connector elements and concrete or a similar material is cast, whereby the blocks formed thereby are mechanically secured to one surface of the interconnecting matrix by engagement of the block-forming material in the cavity defined by the "sled" or hoop and the matrix and/or by integration of the block-forming material through the apertures or openings in the grid-like material of the connector elements.

With the other connector embodiments of this invention, the fingers extend through the matrix and include terminal or free end portions configured to be captured within the concrete or the like blocks cast thereon, or within slots defined in pre-cast blocks.

Because there is no need, utilizing any of the embodiments of the instant inventive concepts, for the block-forming material to pass through openings in the underlying grid-like sheet material matrix, as with prior constructions, it is possible, and desirable as an aid to prevent erosion, for the underlying matrix to comprise a geocomposite, including a geogrid and a geotextile bonded at least to the nodes of the geogrid. Alternatively, a drainage composite such as shown, for example, in U.S. Pat. No. 4,815,892, the subject matter of which is incorporated herein in its entirety by reference, may be bonded to the underside of the grid-like sheet material matrix. In this instance, the sheet material matrix interconnecting the concrete blocks may include a geogrid, a geotextile, a drainage net and another layer of geotextile.

In the production of large geomattresses or the like, gaps extending along at least one longitudinal axis of the block system of this invention are formed between adjacent rows of blocks to permit the same to be bent along that axis for lifting, rolling or folding of the mattress. Thus, an important feature of the material to be used as the interconnecting underlying matrix is that it allows bending along these gaps and has sufficient strength to permit the interconnected block system or mattress to be lifted, with the sheet of matrix material supporting the weight of the plurality of concrete blocks attached thereto.

Before lifting and placing interconnected block systems according to the invention, or even after placement, the gaps between adjacent mattresses may be bridged by an extended length of a splice plate, preferably formed of uniaxially-oriented integral geogrid material. The plate spans the lateral edges of two adjacent sections of geomattress, with the plate being secured to each of the lateral edges, preferably by "bodkin" joints.

In the embodiment where adjacent sections of geomattresses are connected together by a splice plate, a geotextile may extend under one section of geomattress and overlap a section of geotextile extending under a juxtaposed section of geomattress. The overlapping portions of geotextile lie under the splice plate to provide a continuous geotextile layer spanning the sections of geomattresses.

It is also possible, according to the present invention, for a gap between juxtaposed sections of geomattress to be bridged below and/or above by engaging the fingers of end portions of a comb-like connector device within slots formed in aligned surfaces of two adjacent blocks.

If both surfaces of the spaced blocks are interconnected by sheets of matrix, the pockets formed therein could receive and retain aggregate fill material, sorbent particles or a bent section of geonet or the like used as a baffle to slow runoff and trap sediment.

A geotextile may optionally be wrapped about a geomattress to enclose the spaces between the blocks and ensure that a light or buoyant material, such as a sorbent material, e.g., activated carbon particles, cannot float free while permitting environmental water or the like containing contaminants to pass through the block system so that the contaminants can be absorbed or adsorbed by the sorbent material.

Thus, enclosing a geomattress filled with special sorptive material with a geotextile represents one practical and unique way to achieve the placement and stability of the sorptive material in subaqueous conditions. Such a construction also has potential beneficial characteristics for other applications, including acting as a physical barrier, bioturbation barrier, erosion protection, cap stability, and limiting mixing of cap materials with contaminated sediments.

Alternatively, the geotextile can be replaced with a composite material with one or more layers of special sorptive geotextile, or with highly sorptive material such as activated carbon incorporated between geotextile layers. Since the concrete blocks of the invention are secured to only one surface of an underlying matrix sheet, the incorporation of such a sorptive geotextile layer may be readily accommodated.

When casting concrete in situ, it is common to prepare a wooden form which is removed when the concrete has set. Such a procedure is time consuming and labor intensive. Leaving wooden forms in place in the environment for which the interconnected block system of the instant invention is intended would result in the wood or nails eventually disintegrating, the wooden elements floating free of the matrix and thereby polluting the environment.

Therefore, for those embodiments where the concrete blocks are to be cast in situ, this invention also contemplates the use of a casting form that will not deteriorate in water and may be left in place to form part of the interconnected block system. Thus, the casting form may be made of, for example, dry cast concrete, stiffened thermoplastic or thermoset plastic materials, or brick. Due to the crush resistance of such casting forms, it is possible to cast a layer of blocks on a first sheet of matrix material, lay a second matrix sheet over the first layer with additional casting forms overlying the casting forms in the first layer thereby enabling the casting of subsequent blocks as the material in underlying layers is curing. This process may be repeated to form multiple layers of blocks with minimal casting space requirements.

As noted, the use of a composite material as the interconnecting matrix provides the combined benefits of the geogrid and the geotextile or drainage composite in an integral form. The flexural rigidity of the grid composite maintains intimate contact of a filter material or the geotextile with the underlying soil, maximizing erosion protection, drainage, filtration and separation.

Although the preferred embodiments of the instant inventive concepts bond a geotextile or a drainage composite to the underside of a geogrid or the like, for certain applications the geotextile, or even a drainage composite can be bonded to the upper surface of the geogrid. It would then be necessary to provide apertures or openings through the geotextile or drainage composite if the "sled" or hoop block-connectors are to be secured to the matrix, particularly if bodkin connections are utilized to provide this mechanical interlock.

If the anticipated use of the block system is expected to encounter forces along its edges which may tend to overturn or roll-up the block system, the system may be modified to overcome this problem. A tube may be secured to an edge of the system which would prevent such failures. The tube may be made of a woven geotextile sewn into an appropriate configuration with ports for injection of a sand/water slurry. The tube may be anchored to the block system by a grid hoop, either integral with the matrix of the block system or of a separate material, connected by a bodkin connection to the underlying matrix so the tube will not drift.

While the dimensions and configuration of the interconnected block system of this invention are variable depending upon the application, a typical alignment of blocks incorporating the teachings of the present invention would include rectangular blocks approximately 7.5" by approximately 15.5", 1.75 to 4" thick. Alternatively, circular blocks of approximately a 12" diameter may be used. Also, special shapes may be used to further promote the retention of soil or similar materials and to promote the capture of sediment.

In either event, the blocks are preferably arranged in staggered rows, with an offset of each block between adjacent rows of approximately 50%. The staggered arrangement of adjacent rows interrupts flow-through of water, for example at the shore line of an ocean, to prevent straight line erosion between blocks by the return of breaking wave water to the ocean.

To facilitate the lifting of a single or multiple sections of geomattresses, it is envisioned as being within the scope of the present invention to create a sling system by bending and inserting a lifting section of uniaxially stretched geogrid through a section of a geogrid matrix to which the blocks have been attached. The bars formed at the nodes of the strands of the bent section of uniaxial geogrid are restrained by strands of the geogrid matrix to form a loop extending on one side of the matrix. A lifting bar is inserted along the bend of the strands through a plurality of such loops. A crane or other such heavy equipment may then engage the bar to lift the entire geomattress.

The foregoing and other objects of the instant invention, as well as many other attendant advantages, will become more readily apparent when reference is made to the following description taken in conjunction with the accompanying drawings.

DETAILED DESCRIPTION OF THE PREFERRED EMBODIMENTS

Figure 1:
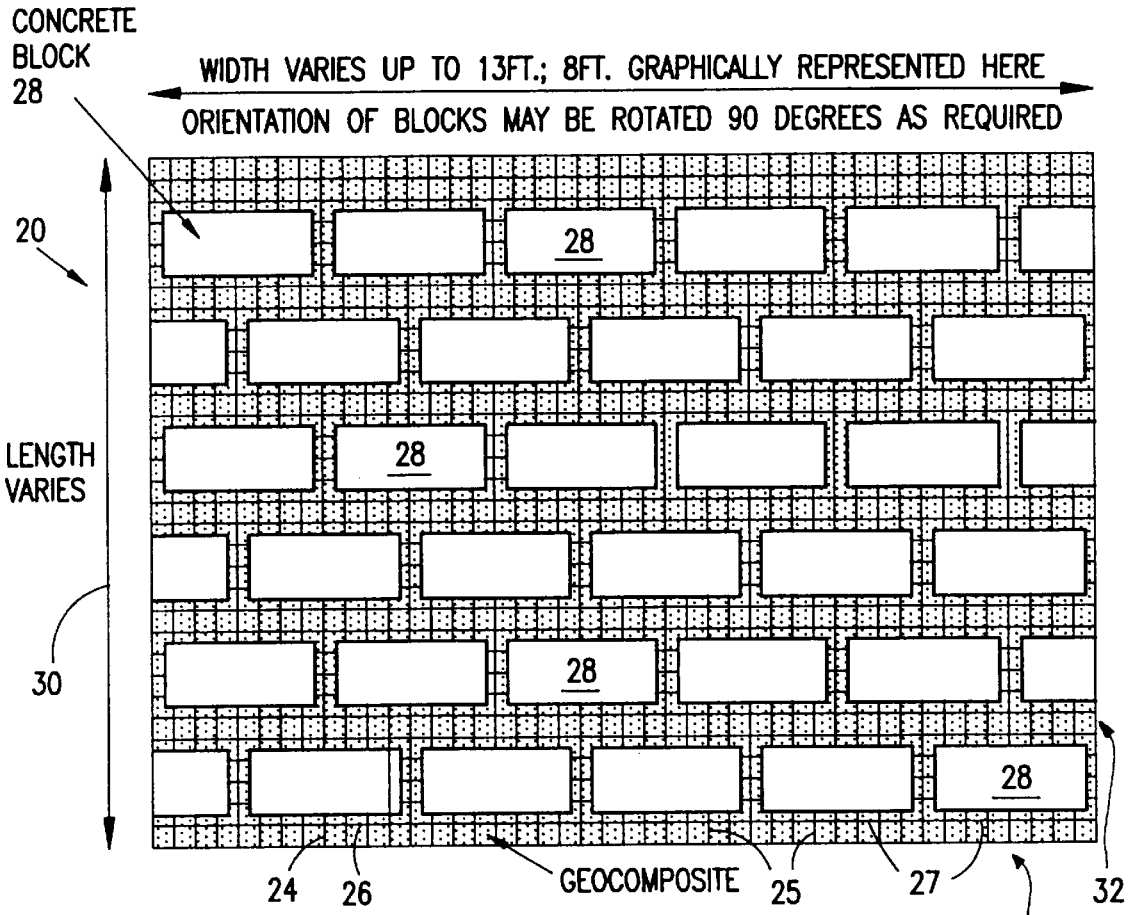
FIG. 1 is a plan view of a plurality of blocks interconnected by an underlying sheet material matrix according to one embodiment of this invention.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, one form of an interconnected block system or mat or mattress embodying the teachings of the subject invention is generally designated as 20, and includes an underlying, interconnecting, sheet material matrix 22 carrying a plurality of block members 28 formed of concrete or a similar material, rectangular blocks being shown in FIG. 1, although other geometric shapes are equally applicable to this invention.

While reference is made herein to the use of concrete as the preferred block-forming material, it is to be understood that this term is intended to include other similar materials, whether cementitious or not, including, particularly, well known thermosetting polymeric compositions which form concrete-like panels or blocks when solidified.

The matrix 22 includes a grid-like material formed by a plurality of parallel strands 24 interconnected at nodes or junctions 25 to parallel strands or bars 26 extending perpendicular to strands 24 to define therebetween a multiplicity of apertures 27. As indicated above, the grid-like sheet material of the matrix 22 may be an integrally formed uniaxially or biaxially oriented structural geogrid, a bonded composite open mesh structural textile, or for that matter, any grid-like material capable of supporting the plurality of blocks to which the connector elements may be mechanically secured. However, the preferred matrix material for large installations includes an integrally formed, uniaxially oriented, structural geogrid where the bars 26 are unoriented or less oriented and, thus, thicker than, the strands 24 for improved strength.

A plurality of concrete blocks 28 are secured to the matrix 22 in parallel rows as shown in FIG. 1. Between each row of blocks is a gap 32 which allows bending of the matrix 22 between the blocks to permit the section to assume a non-planar condition for lifting and in use. When the gap between adjacent rows of blocks is large enough, the section may be folded upon itself for lifting and transporting.

The blocks in juxtaposed rows are preferably staggered or offset by 50% so that water flowing in the direction of arrow 30 would be interrupted to minimize erosion from straight line flow between the blocks.

If multiple sections of matrix material are to be interconnected to form an enlarged mattress, it is contemplated that some of the blocks 28 could be positioned and dimensioned to span adjacent sections so as to integrate the underlying matrix material. In any event, the spacing between juxtaposed blocks 28 is related to the dimensions of the matrix material so as to uniformly position the blocks and balance the system. Likewise, the size and shape of the blocks are site and application specific and can be widely varied without departing from the instant inventive concepts.

For example, FIG. 1 depicts a block width that may be used for lining an ocean shoreline. Other block widths may be used for a boat ramp or for a channel lining application. The width and thickness of each concrete block are predicated on the desired coverage, the slope angle and the energy associated with the waves or flow velocity of the water which the concrete system would have to withstand and, therefore, these dimensions can vary. The length of each block can vary and may be designed to accommodate the commercially available grid-like sheets of material used to support and interconnect the blocks in the system.

Figure 2:
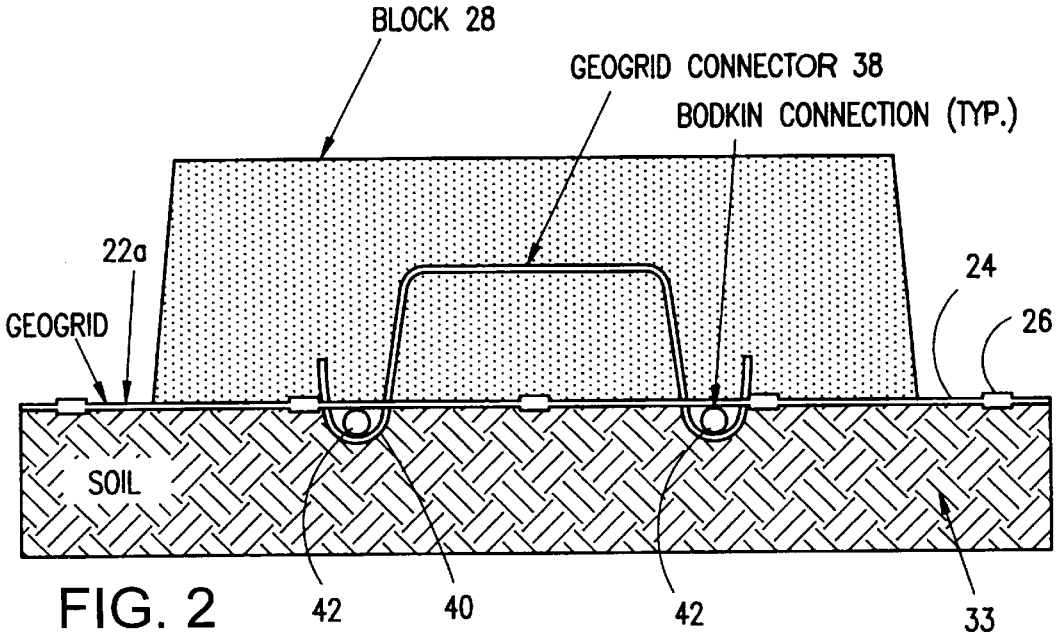
FIG. 2 is a schematic cross-sectional view illustrating the interconnection of a block to a matrix formed of geogrid or the like, using one form of mechanical connector element or "sled" according to this invention.
Figure 3:
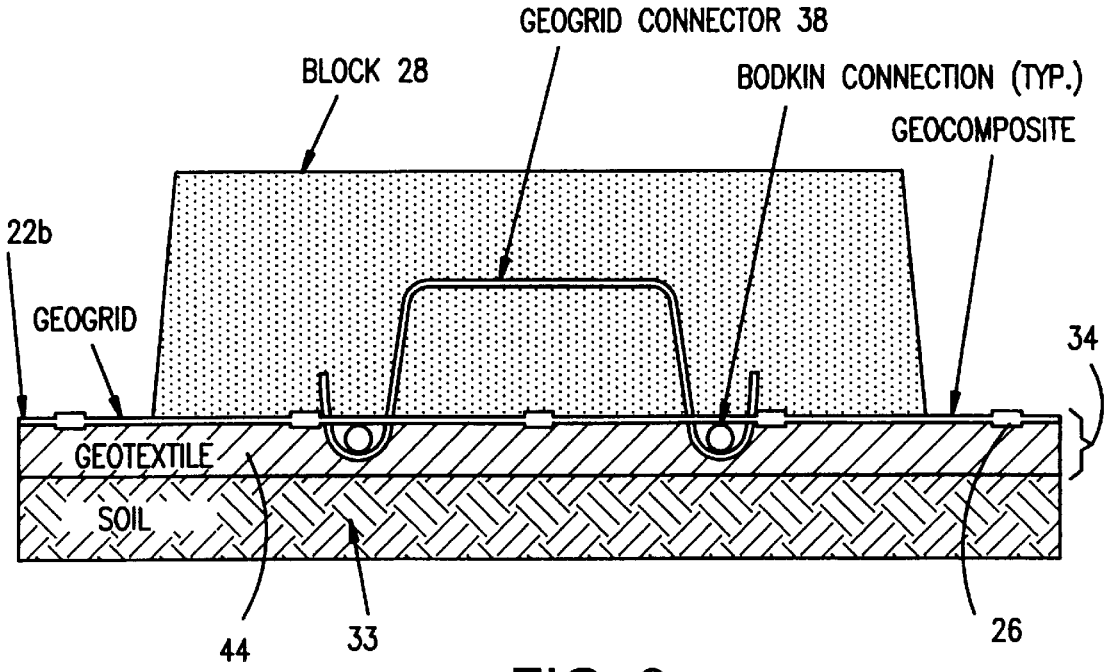
FIG. 3 is a similar schematic view showing the use of an underlying sheet material matrix formed of a geocomposite including a geogrid bonded to a geotextile material according to a preferred embodiment of this invention.
Figure 4:
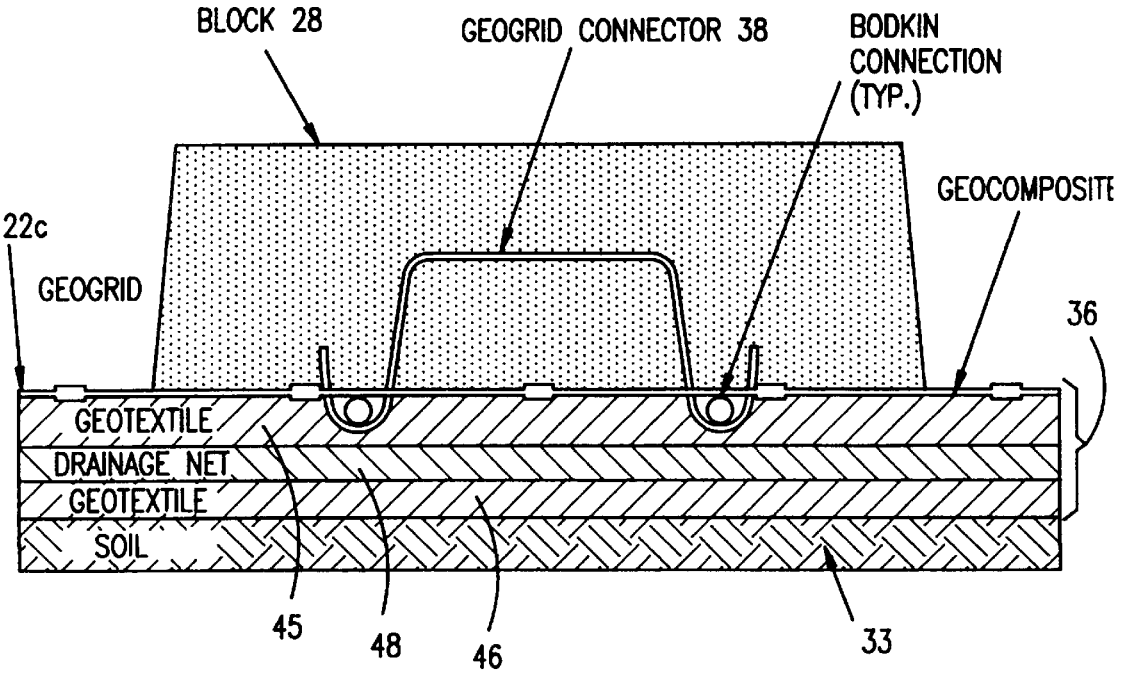
FIG. 4 illustrates a modified supporting geocomposite matrix including a double-sided drainage composite bonded to a geogrid, and comprising geotextile, a drainage net and an underlying layer of another geotextile.

In FIGS. 2 through 4, a bodkin type of mechanical connection between different matrices and a connector element according to this invention is illustrated. In FIG. 2, the underlying, interconnecting matrix 22a is simply a grid-like sheet material, such as an integral uniaxially oriented structural geogrid or the like, in direct contact with the soil 33. In FIG. 3, the matrix 22*b* is a geocomposite 34 including a geogrid or the like bonded to a geotextile. In FIG. 4, the matrix 22*c* is a geocomposite including a geogrid or the like bonded to a double-sided drainage composite.

The connector elements 38 are preferably formed of a grid-like material which may also be formed, for example, of an integral structural geogrid, either uniaxially or biaxially oriented, or a bonded composite open mesh geotextile. The mechanical engagement between the matrix 22 and the connector element 38 may take any form, but a bodkin connection, as discussed above, is preferred. With such a construction, the grid-like material of the connector element 38 is bent so that, at opposite ends, its strands 40 form a loop which is passed through the openings in the top surface of the grid-like material of the matrix as seen in FIGS. 2–4. The connector elements 38 are secured in place by connection or bodkin bars 42 which pass through the loops beneath the grid-like material of the matrix to preclude the connector elements from being disengaged.

Casting forms (not shown in these Figures) are positioned about each of the upstanding connector elements 38 and concrete or the like is cast in place to capture the connector elements 38 within the thus-formed blocks 28 and thereby mechanically connect the blocks 28 to the upper surface of the matrix 22.

The strength of the mechanical connection of the blocks 28 to the matrix 22 is provided by the engagement of the concrete-like material of the blocks through openings, apertures or cavities formed by the connector elements 38 alone, or in association with the upper surface of the matrix 22, with no need for the block-forming material to pass through or engage in the apertures of the grid-like material of the matrix. This construction permits the matrix to include more than just a geogrid or the like, enabling the use of a geocomposite matrix such as shown at 34 in FIG. 3 wherein a grid-like material is bonded to a geotextile 44 either at the bars 26 of the geogrid section 22 when uniaxial geogrid is used or at the nodes 25 formed between the intersections of the bars and the strands when a biaxial geogrid is part of the composite 34. Likewise, a geocomposite matrix such as shown at 36 in FIG. 4 may include a double-sided drainage net comprising upper and lower geotextiles 45, 46 with an intermediate layer of geonet 48 sandwiched therebetween.

Geocomposites such as illustrated at 34 in FIG. 3 are available from Tensar as their GC3320 laminate and drainage composites such as illustrated at 36 in FIG. 4 are available from Tensar as their DC 6205 laminate.

As indicated, since there is no need for the block-forming material to pass through the openings of the matrix material, a geotextile or drainage composite can form the matrix or the upper layer of the matrix, so long as means are provided to secure the connector elements 38 thereto.

In any event, the ability to integrate a geotextile into the matrix using the construction of this invention avoids the need to separately position a geotextile at the work site as is customary to minimize erosion of the soil below a geomattress or the like.

Several different embodiments of the construction of the connector element are illustrated in FIGS. 5–10. In each instance a geocomposite matrix of the type shown at 34 in FIG. 3 is illustrated, but it is understood that any of the various matrices disclosed herein may be substituted therefor.

Figure 5:
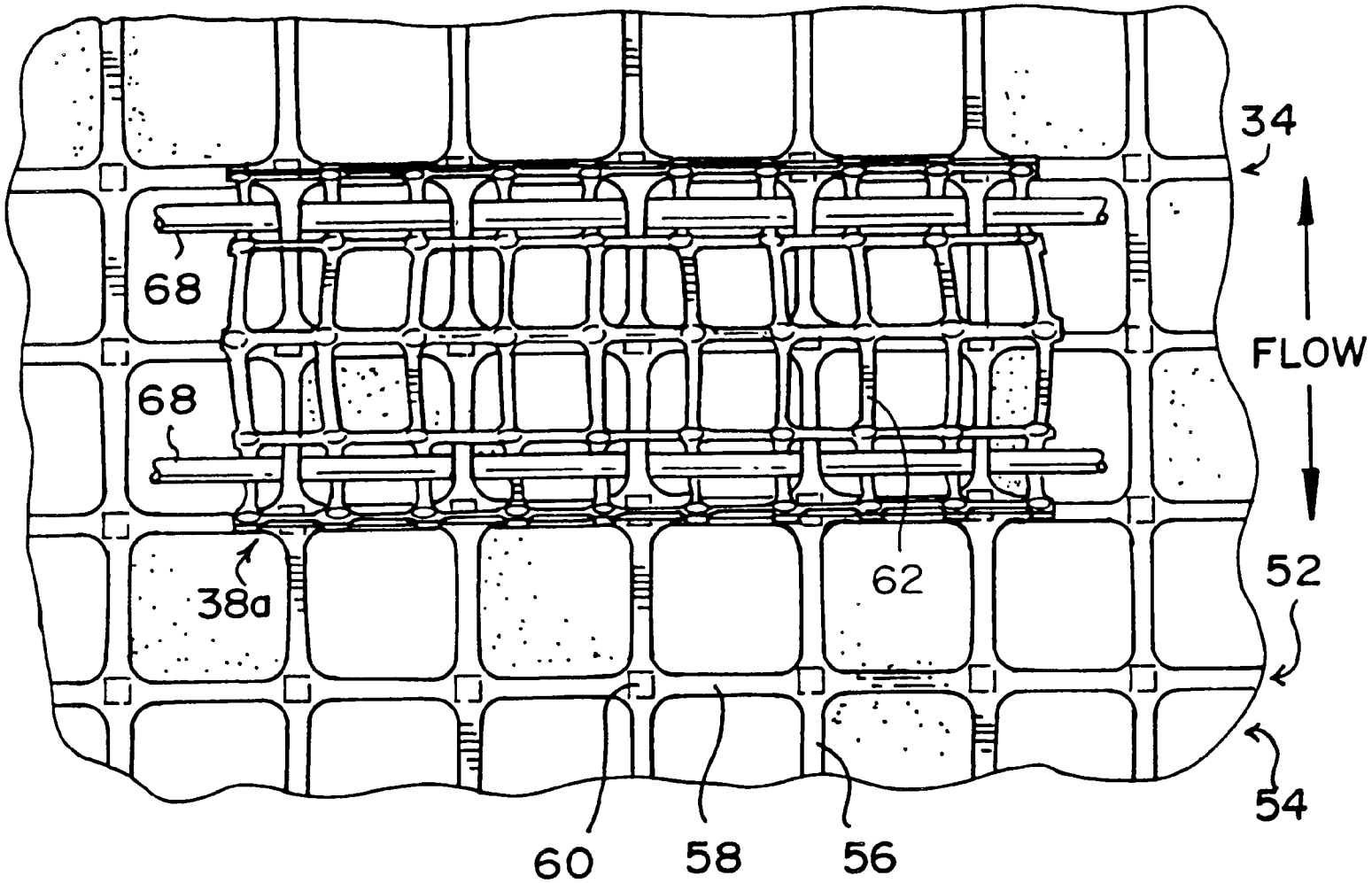
FIG. 5 is a plan view of one form of connector "sled" according to this invention secured to the geogrid layer of a geocomposite matrix prior to casting a block thereon, the connector element being formed of a biaxially oriented integral structural geogrid and being connected to the matrix by a pair of bodkin connector bars.
Figure 6:
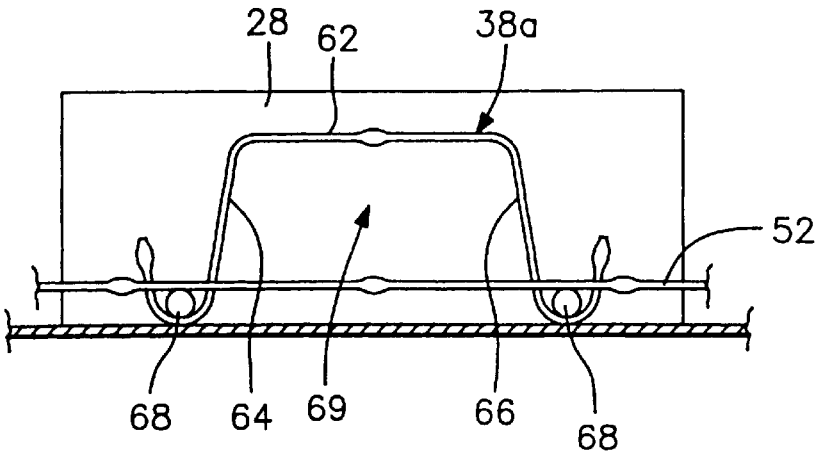
FIG. 6 is a side view of the connector arrangement shown in FIG. 5, with finished blocks shown behind the connector element.

In FIGS. 5 and 6, a connector element 38*a* is shown for securing a block 28 to the geocomposite matrix 34 which comprises an integral biaxially oriented structural geogrid 52 having a geotextile 54 bonded thereto. The geogrid 52 includes strands 56 arranged perpendicular to strands 58 intersecting at nodes 60.

In this embodiment, as seen particularly in FIG. 6, the connector element 38*a* is made of a small section of biaxial geogrid 62 having opposite end portions 64 and 66 projecting above the upper surface of the geogrid 52 of the matrix geocomposite 34. Loops formed of the geogrid 62 pass through the openings in the geogrid 52 of the matrix and receive bodkin connector bars 68 to lock the connector element 38*a* to the geocomposite 34. As shown in FIG. 6, the geogrid 52 and geotextile 56 of the matrix may deflect slightly so as to accommodate the connector bars 68 below the geogrid 52 and above the geotextile 54.

Projecting above the upper surface of the geocomposite 34 is a U-shaped portion 68 of the geogrid connector element 52. When a block 28 is cast (as shown behind the connector element 38*a* in FIG. 6), the block-forming material captures the portions of the geogrid connector 62 projecting above the upper surface of the matrix, namely ends, 64, 66 and U-shaped portion 68, and thereby integrates the block 28 with the geocomposite 34.

While, to a limited extent, the block-forming material is secured to the connector element 38*a,* and thus to the geocomposite 34, by frictional engagement with the surface of the material of the connector element and the upper surface of the geocomposite, for most applications such attachment would be inadequate. However, in the embodiment of FIGS. 5 and 6, the block-forming material can pass through the apertures of the geogrid 62 to surround and capture the strands of the connector element 38*a.* Moreover, a large cavity or reservoir 69 is formed between the lower surfaces of the connector element 38*a* and the upper surfaces of the geocomposite 34 which enables the block-forming material to capture the connector element 38*a* to secure the block to the geocomposite 34, even if the connector element and the matrix were, for all intents and purposes, imperforate.

Figure 8:
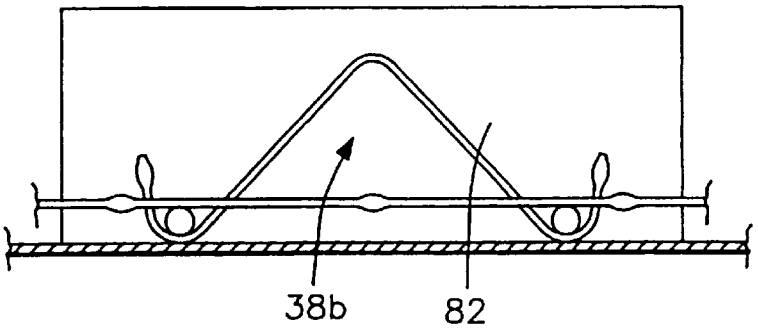
FIG. 8 is a side view of the connector arrangement shown in FIG. 7.
Figure 7:
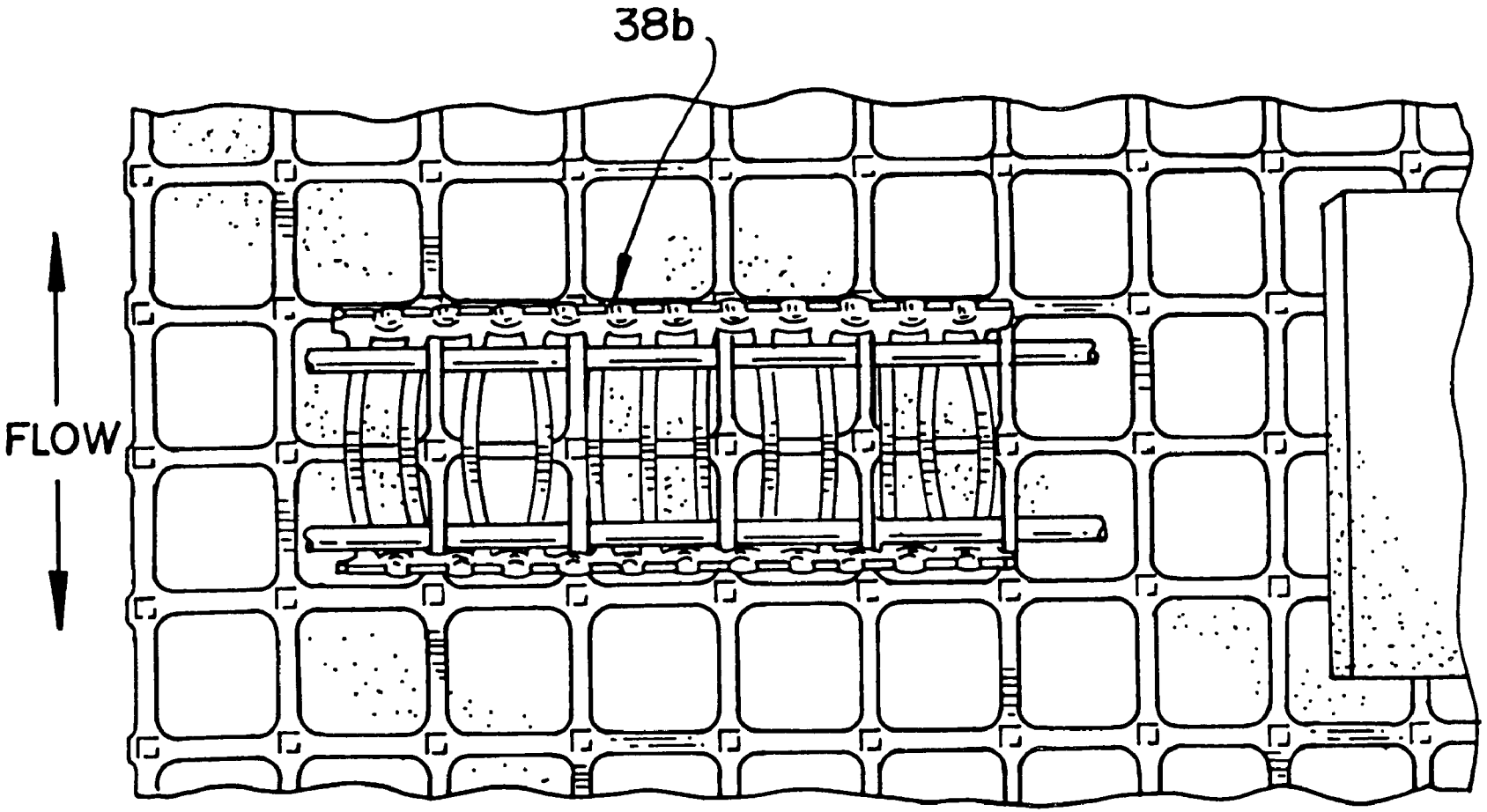
FIG. 7 is a plan view similar to FIG. 5 of an embodiment of the instant invention wherein the connector element is formed of a modified integral structural geogrid.

In the alternative embodiment as shown in FIGS. 7 and 8, the geocomposite 34 is engaged with a section of a somewhat different configuration of biaxially oriented geogrid connector element 38*b* which provides a centrally located, generally V-shaped, portion 82 projecting above the upper surface of the geocomposite 34, rather than the U-shaped connecting portion 68 of the previous embodiment. obviously, the type of material used to form the connector element can be varied significantly without departing from the instant inventive concepts.

Figure 10:
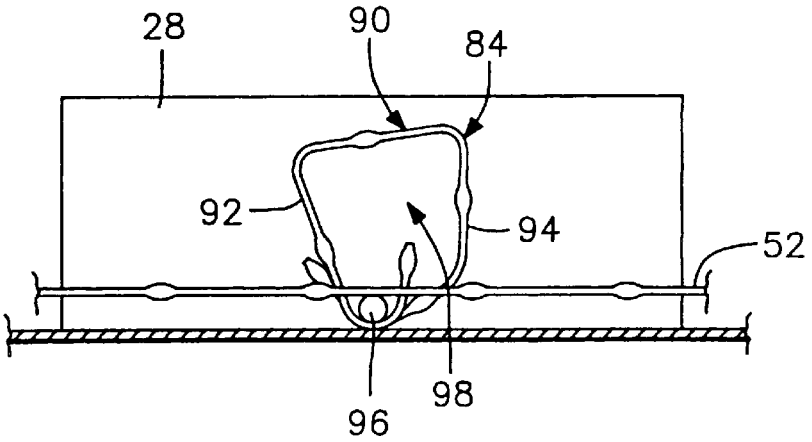
FIG. 10 is a side view of the hoop connector arrangement shown in FIG. 9.
Figure 9:
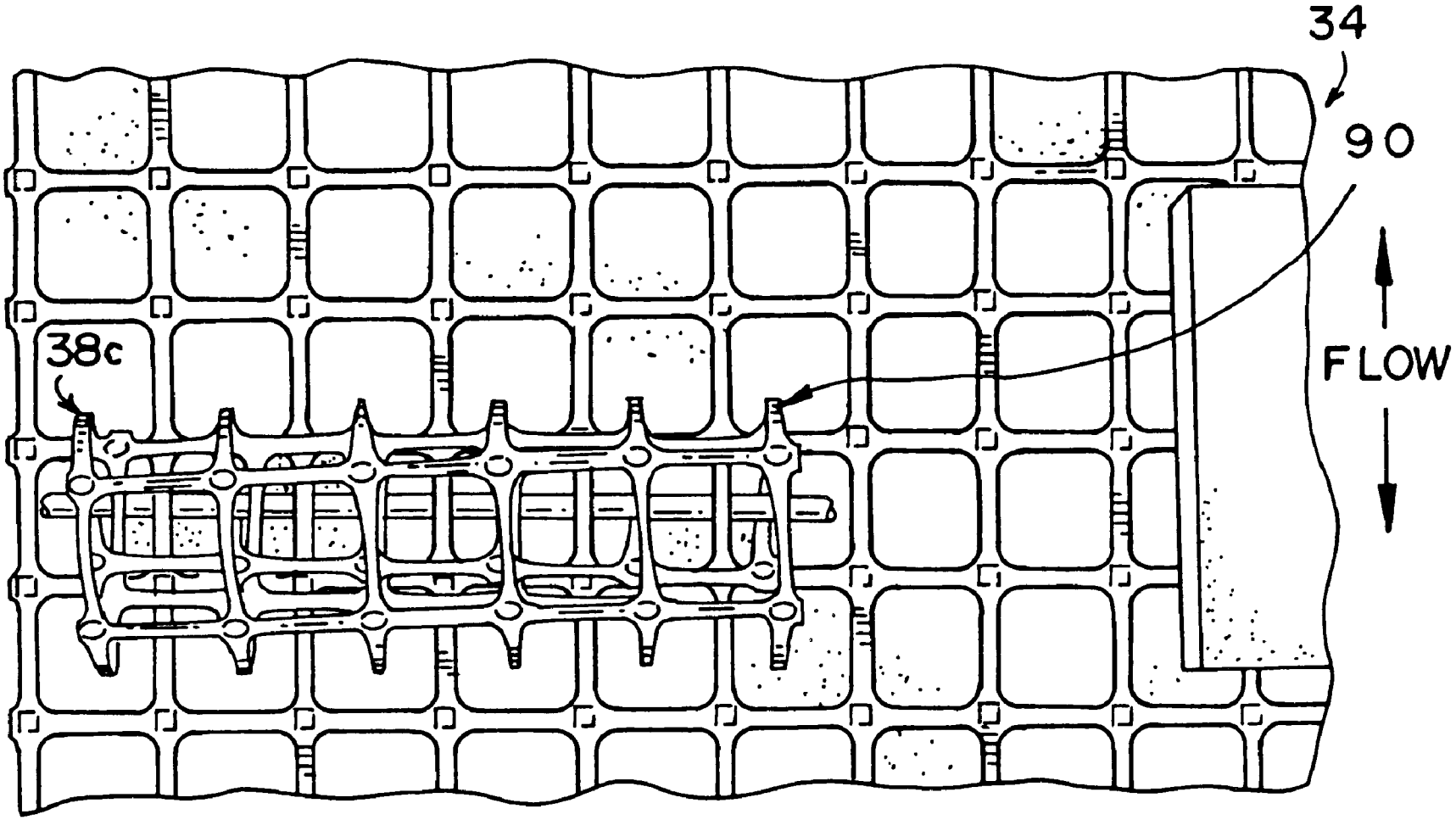
FIG. 9 is a plan view of yet another embodiment of connector element formed as a hoop of a biaxially oriented integral structural geogrid material secured to a geocomposite matrix by a single bodkin connector bar.

In FIGS. 9 and 10, a modified connector element 38*c* comprises a biaxial geogrid material 84 formed into a circular hoop 90. The opposed ends 92 and 94 of the geogrid 84 project above the upper surface of the geocomposite matrix 34 with strands of both ends of the connector element 38*b* projecting through the geogrid 52 of the matrix at the same location so that a single connector bar 96 may be used to hold the connector element 38*b* in place. The connector element 38*b* may be slightly compressed, if necessary, prior to block casting so that it is below the overall height of a concrete block 28 to be cast in place on the geocomposite matrix 34. In this embodiment, the hoop 90 defines an internal cavity 98 for reception of concrete or the like which amplifies the integration of the block-forming material with the connector element and improves the interengagement of the block 28 with the matrix 34.

Figure 11:
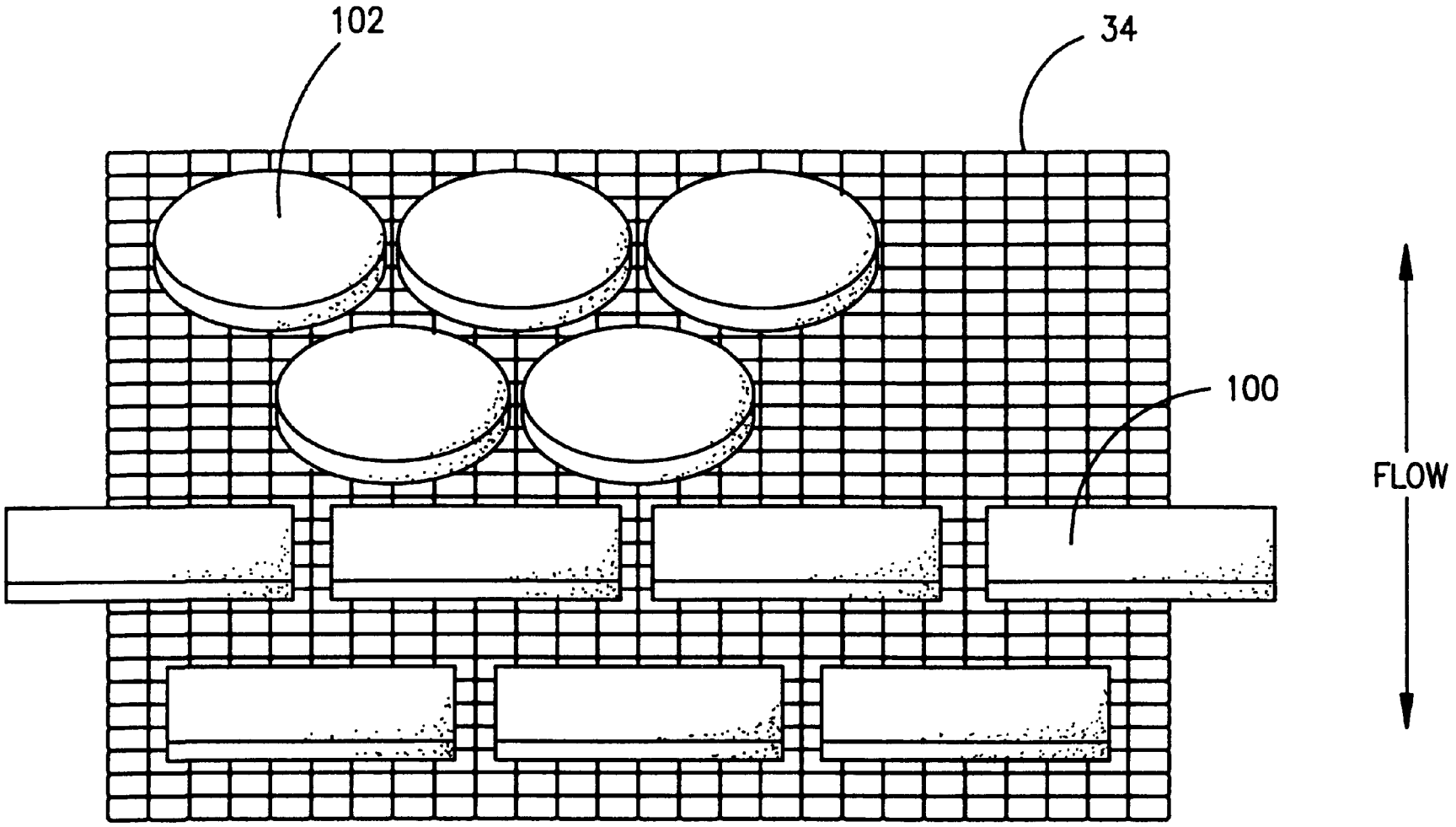
FIG. 11 is a perspective view illustrating the concept of staggering the concrete blocks on the underlying sheet matrix in a direction perpendicular to the flow of water in use and aligning the blocks in the opposite direction to provide bending gaps, both rectangular and circular blocks being shown on the same matrix merely for illustrative simplicity.

To illustrate the preferred arrangement of the blocks on the matrix, a plurality of rectangular blocks 100 and circular blocks 102 are shown on a single geocomposite matrix 34 in FIG. 11. It is understood that in use, the block system of the present invention will generally include all rectangular blocks or all circular blocks, or blocks of other geometries, but, in any event, alternate rows of blocks will be staggered as seen in FIG. 11 to provide lifting gaps between the rows and to interrupt water flow perpendicularly to the lifting gaps.

Figure 12A:
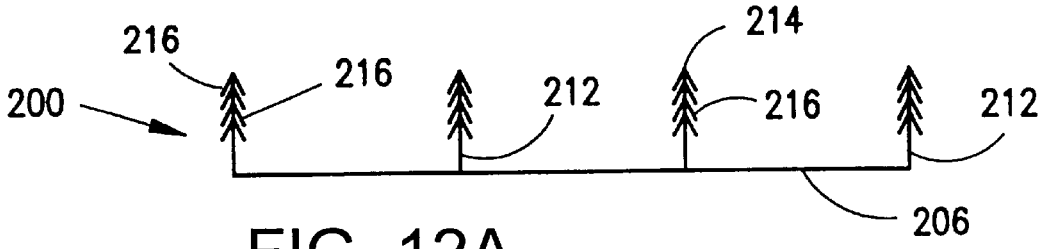
FIGS. 12A through 12C are schematic side elevational views of three connector strips for securing concrete blocks to a matrix according to another embodiment of the instant inventive concepts without need for the concrete to pass through the matrix material.
Figure 12B:
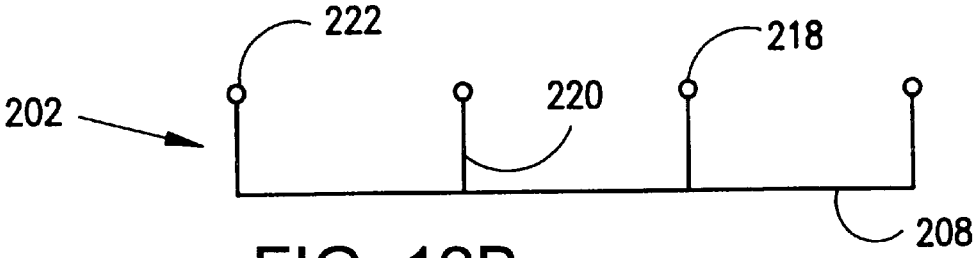
Figure 12C:
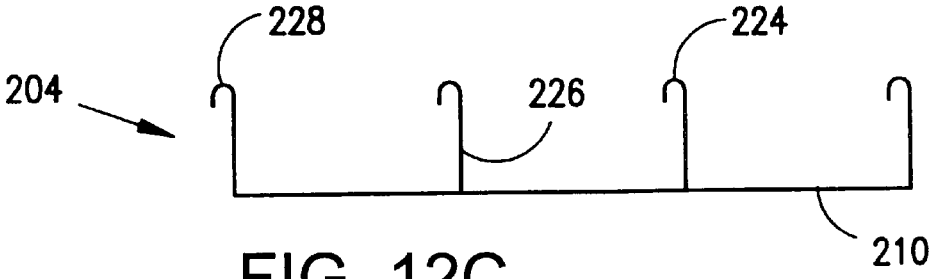

As an alternative to the connectors shown in FIGS. 2 through 10, a strip connector as shown in FIGS. 12A, 12B, or 12C may be used. The strip connector 200 shown in FIG. 12A, strip connector 202 shown in FIG. 12B and strip connector 204 shown in FIG. 12C, each include a base or mat 206, 208, 210, respectively. The base may be made of plastic or other semi-rigid material and be of an overall length less than the block member which is to be secured to the matrix.

With respect to strip connector 200, a plurality of vertically-extending fingers 212 extend perpendicular to the base layer 206. At the free end 214 of the fingers 212, a plurality of barbs 216 are provided extending towards base layer 206 at an angle with respect to the main shaft of fingers 212. Similarly, in strip connector 202, at the free end 218 of each of the fingers 220 is located a ball or enlargement 222. In strip connector 204, the free end 224 of the fingers 228 includes a hook-shaped terminal portion 226 which curves around from the finger 226 in a direction back towards the base layer 210.

The number of fingers in each strip connector may be more or less than that shown in FIGS. 12A through 12C. It is only essential that the number of fingers is sufficient to retain a block member cast thereon and secure the same to the underlying matrix. Likewise, while specific formations in the nature of barbs, balls and hooks on the free ends of the fingers are shown herein as illustrative, it is only important that the fingers be provided with means to insure that the block-forming material will not readily separate therefrom. Thus, other formations adapted to insure capture and secure engagement of the connector elements with the block-forming material, including even apertures through the fingers (not shown) can be substituted for the illustrated formations.

Figure 13:
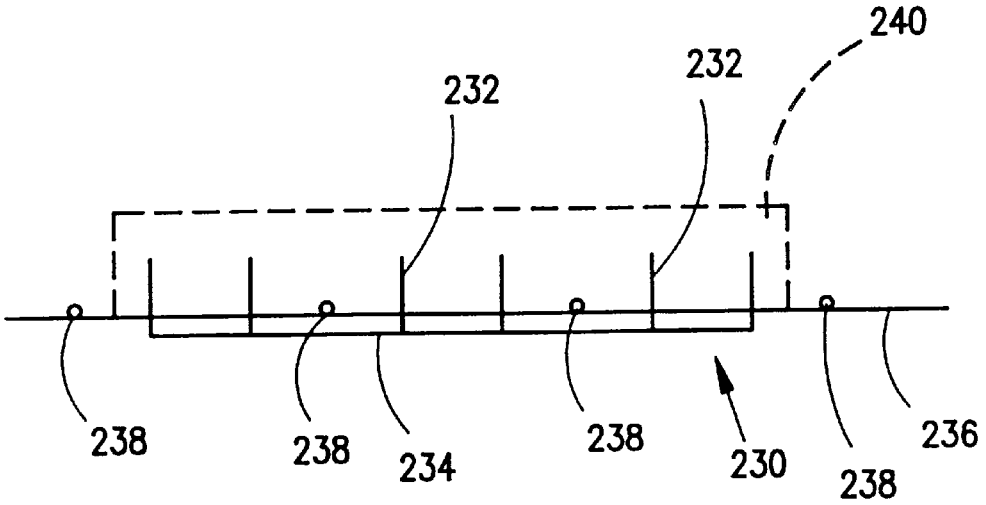
FIG. 13 is a schematic elevational view of a generic connector strip, representative of one of the specific connector strips in FIGS. 12A through 12C, with the fingers of the connector strip projecting through a matrix and into a concrete block (shown in phantom).

In FIG. 13, a strip connector 230 is shown as including fingers 232 projecting through a matrix material layer 236 with pairs of fingers extending between each bar 238 of the geogrid forming part of the matrix. It is understood that the strip connector 230 may have multiple rows of fingers 232, although only a single row is shown for illustrative purposes. The matrix 236 may be simply formed of a geogrid or it may be a geocomposite including a geogrid or the like bonded to a geotextile. The preferred use of a geocomposite facilitates engagement of the strip connector with the matrix, particularly during the block-casting procedure, because the geotextile surrounds and thereby retains the fingers in position.

As was explained with respect to the previous embodiments, a block member 240, shown in phantom, is cast upon the matrix 236 so as to engage and surround the portions of the fingers 232 extending above the matrix 236.

Figure 14:
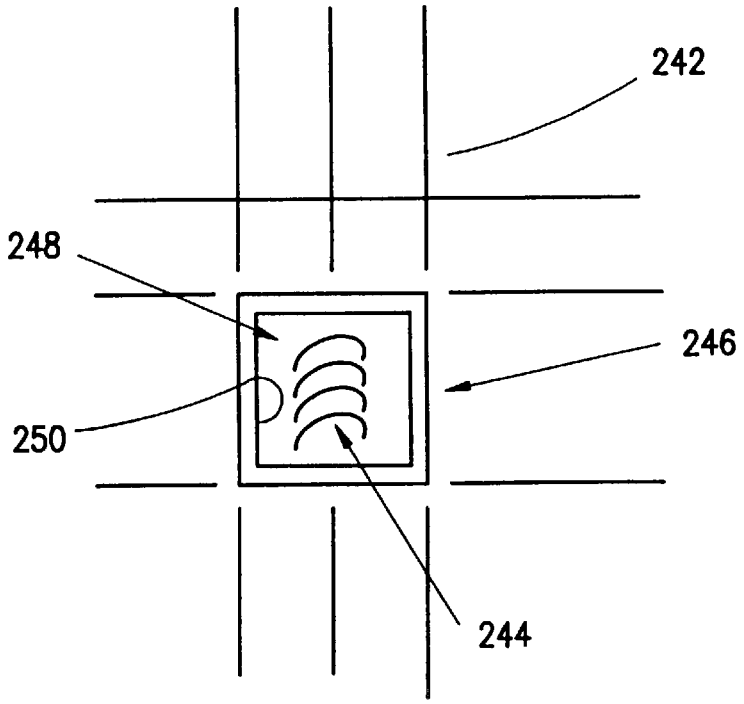
FIG. 14 is a plan view of a casting form located on top of a grid composite and surrounding a connector "sled".
Figure 15:
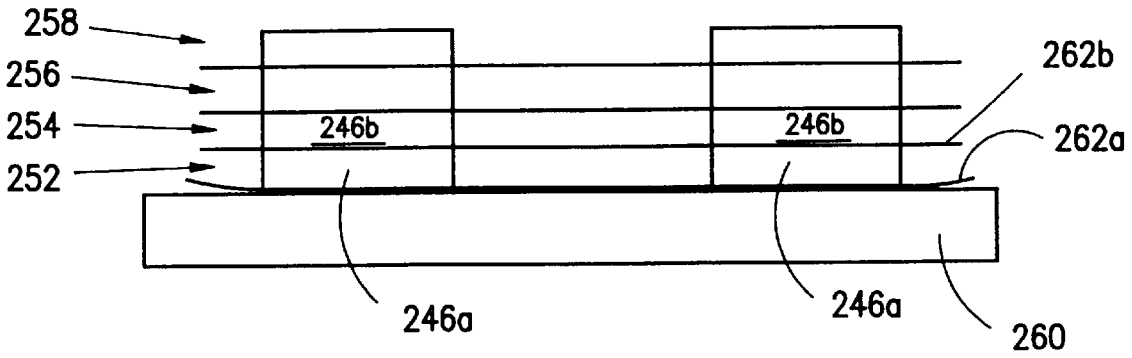
FIG. 15 is a schematic elevational view of a plurality of layers of grid composite mounted between casting forms for casting of several block systems in a limited space, and in the example shown, on a truck bed or barge.

In FIGS. 14 and 15, a preferred casting arrangement for forming block members on top of an underlying sheet material matrix 242 is illustrated. A connector 244 is anchored to the matrix 242. The connector 244 may be of the type shown in FIGS. 2 through 10 or of the type shown in FIGS. 12A through 13. In this embodiment, a pre-fabricated form or mold 246, in the shape of the to-be-formed block member, is placed about the connector 244. The mold may be made, for example, of a unitary piece of dried cast concrete, stiffened thermoplastic or thermoset polymer, or brick. The mold 246 is intended to remain permanently in place when the mold is filled with concrete 248, or the like, the concrete adhering to the connector 244 as well as the interior wall 250 of the mold 246. The mold would then become a unitary piece with the to-be-formed block member.

By the use of a stiff mold member, it is possible to cast a plurality of layers 252, 254, 256 258 as shown in FIG. 15, in a limited space, such as a truck bed or barge 260. Initially, in layer 252, matrix 262*a* will include a plurality of the mold members 246*a* surrounding a connector (not shown). Concrete is then poured into the mold members 246*a*. While the concrete of layer 252 is curing, a second matrix 262*b* is placed across the first layer 252 and new mold members 246*b* are stacked on top of the mold members 246*a* of the first layer 252. The rigidity of the mold members 246*a* in the first layer is sufficient to support the mold members in the second layer so that a second pouring of concrete can be made while the concrete in the first layer is curing. This process is repeated for layers 256 and 258 until a desired number of layers of matrix material with block members is achieved.

Figure 16:
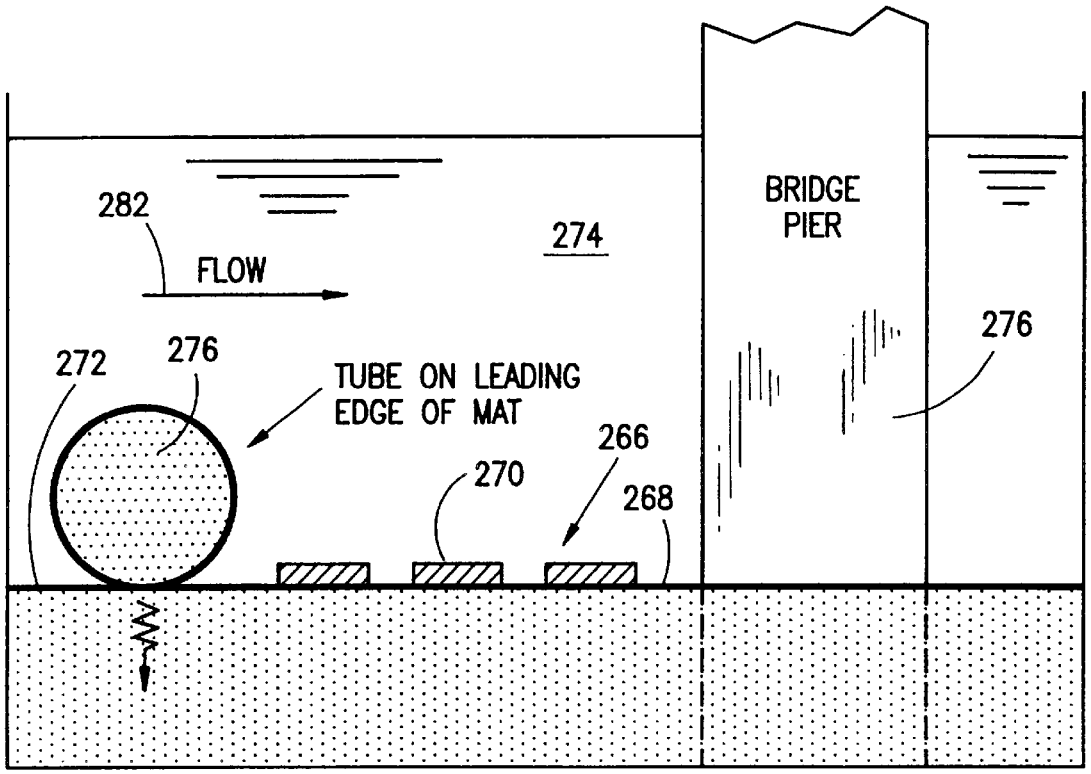
FIG. 16 is a schematic illustration of an interconnected block system located under water adjacent to a bridge pier with an anchoring tube secured to a leading edge of the block system.
Figure 17:
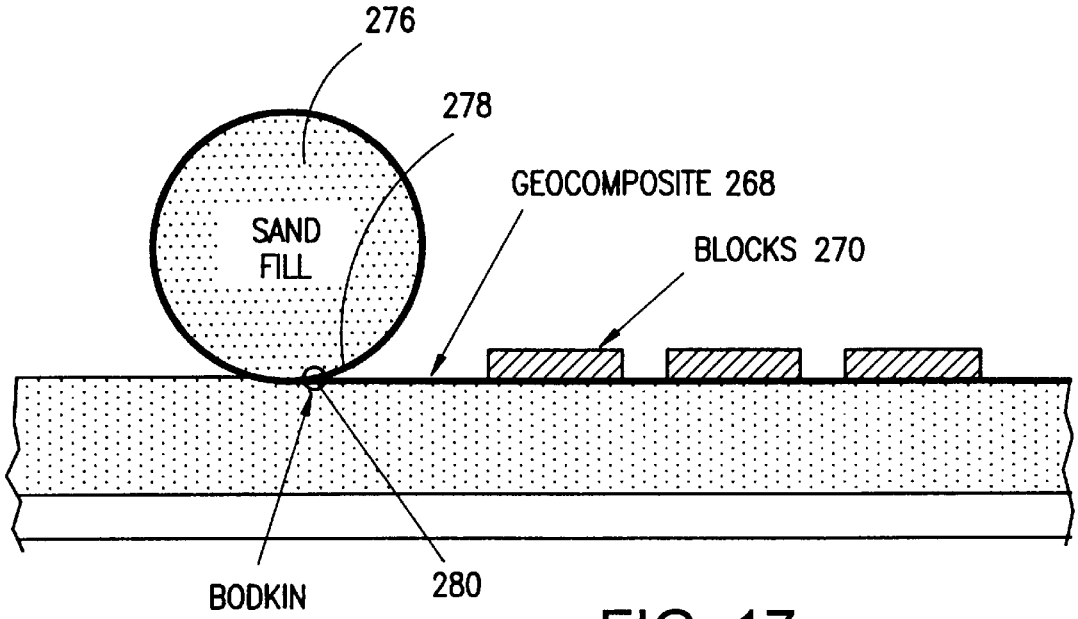
FIG. 17 is an enlarged detailed view of the connection of the sand tube shown in FIG. 16 to the leading edge of the block system.

In FIGS. 16 and 17, an interconnected block system 266 including a matrix 268 and plurality of block members 270 is shown located on the floor 272 of a waterway 274. The interconnected block system is positioned adjacent to a pier 276 so as to limit the erosion about the base of the pier.

As is known in the use of cable-tied blocks and grout mats, failure of these under water systems occurs by the overturning and rolling up at the leading edge of the mat if the mat is not adequately anchored or toed in. In addition, at high water velocities, if the leading edge is not adequately anchored, an uplift of the inner portion of the mat can occur.

To overcome these problems, it is contemplated as being within the scope of the present invention to use a woven geotextile tube 276 which is a closed tube with ports for injecting a sand/water slurry. To anchor the tube 276 to the block system 266 of the present invention as shown in FIG. 16 and as shown in greater detail in FIG. 17, a leading edge 276 of the matrix 268 is extended around the tube 276 and secured to itself by a bodkin type of mechanical connection using a connection or bodkin bar 280 which passes through the loops beneath the grid-like material of the matrix 268.

Alternatively, a section of matrix can surround the tube 276 and be secured to itself as well as to a leading edge portion of the matrix of the block system by a bodkin-type mechanical connection to anchor the additional portion of matrix material to the block system 266. This will anchor the leading edge of the system against movement by water forces in the direction of arrow 282.

Figure 18:
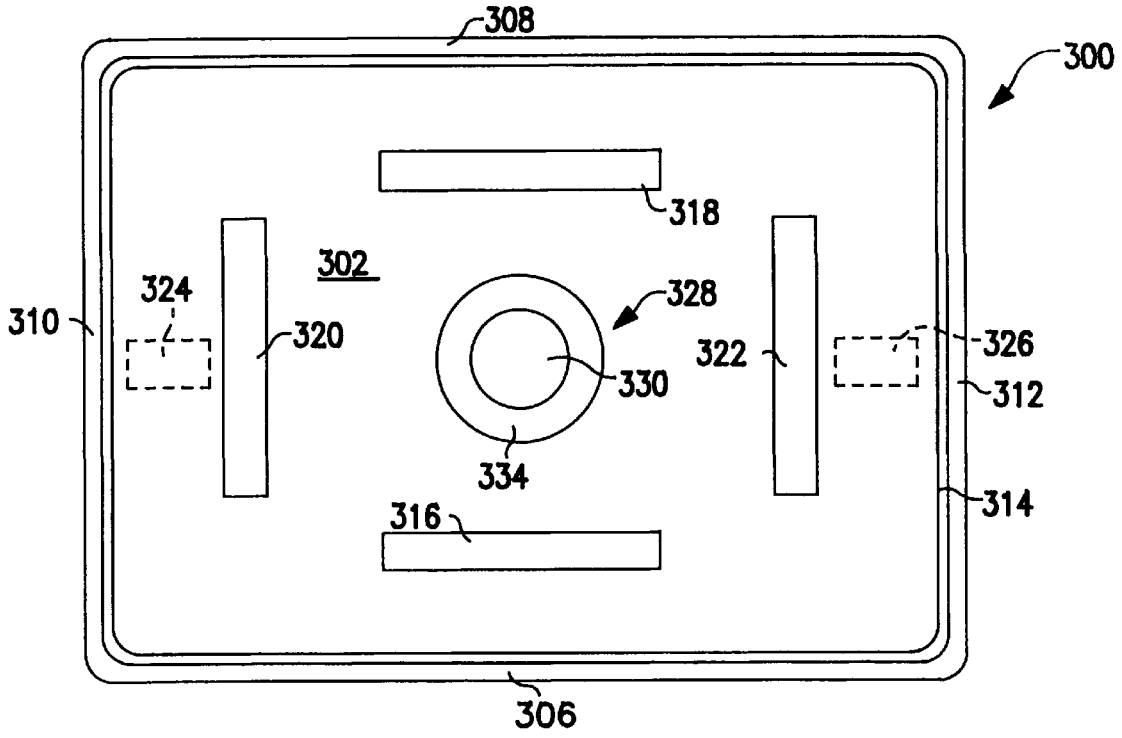
FIG. 18 is a plan view of an alternative block to be secured to a sheet material matrix according to this invention.
Figure 19:
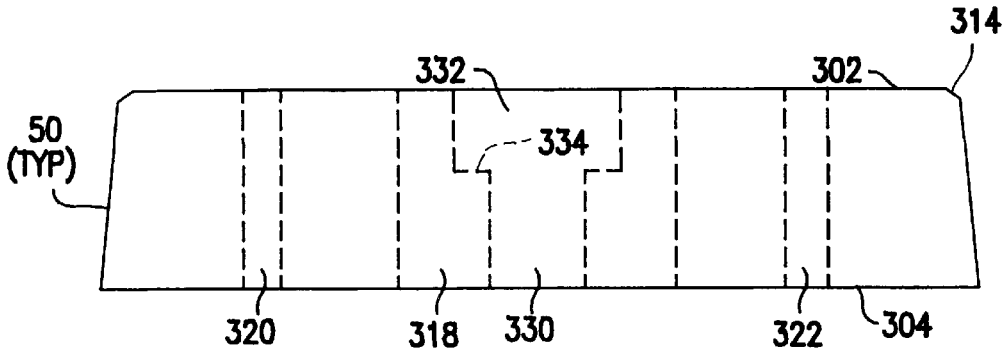
FIG. 19 is a front elevational view of the block shown in FIG. 18.
Figure 20:
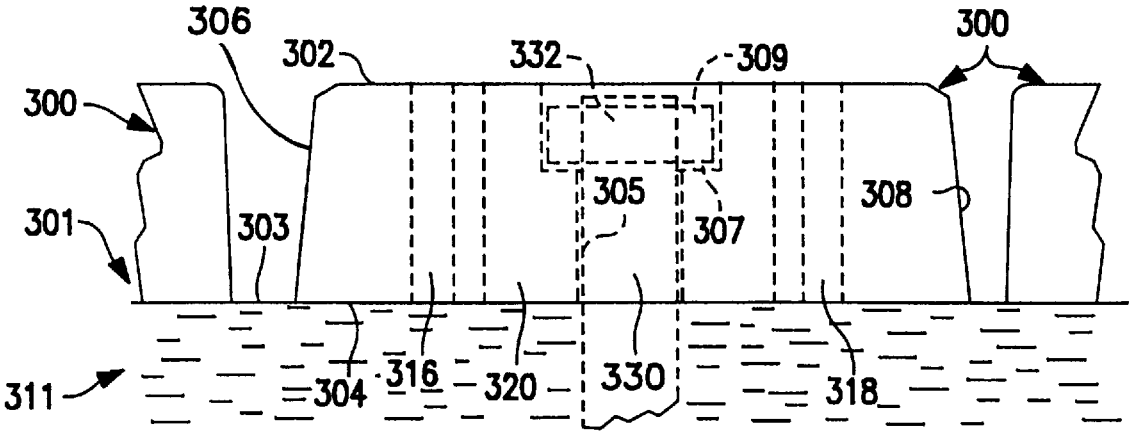
FIG. 20 is a schematic side elevational view of the block shown in FIG. 18 used in a geomattress for erosion control.

Referring now particularly to FIGS. 18–25, an alternative interconnected block system is illustrated which preferably utilizes a preformed block 300, shown in detail in FIGS. 18 through 20. The block 300 includes an upper surface 302, a lower surface 304, and front wall 306, rear wall 308 and side walls 310, 312 each of which tapers upwardly at an angle of preferably 5° from the lower surface 304 towards the upper surface 302. A one-quarter inch chamfered surface 314, surrounds the upper surface 302 of the block and connects the upper surface with the front wall, rear wall and side walls. The overall dimensions of the block 300 are preferably about 15.625 inches long, 11.625 inches wide and 3.625 inches deep.

A plurality of slots are formed in the block 300 for use in securing the block to an interconnecting matrix sheet in a manner to be discussed hereinafter. If the blocks are to be secured only to an underlying matrix, the slots may be formed only in the lower surface 304. If underlying and overlying matrices are to be used as described below, slots may be formed in both the lower surface 304 and the upper surface 302. For ease in manufacture and versatility in use, the slots may extend between the upper surface 302 and the lower surface 304 as illustrated in FIGS. 18–20. Slots 316, 318, 320 and 322 are preferably about five inches long and 0.7 inches wide.

The slots 316 and 318 extend in a direction parallel to the front and rear walls 306, 308, the edges of the slots 316, 318 located closest to the front and rear walls being preferably spaced approximately two inches from the walls, respectively. Lateral edges of the slots 316, 318 are spaced approximately 5.3 inches from the side walls 310 and 312.

The slots 320, 322 extend in a direction substantially parallel to the side walls 310, 312 and the edges of the slots 320, 322 located closet to the side walls are preferably spaced approximately 2.6 inches from the side walls, respectively. Lateral edges of the slots 320, 322 are spaced approximately 3.3 inches from the front and rear walls 306, 308.

Located between the slots 320 and 322 and the side walls 310 and 312 are optional slots 324 and 326 designed to facilitate interconnecting juxtaposed geomattresses in a manner to be described hereinbelow. These slots extend perpendicular to the direction of extension of slots 320 and 322. The slots 324, 326 may also extend between the upper surface 302 and the lower surface 304 and preferably have a length of approximately two inches and a width of 0.7 inches.

As suggested above, the slots 316, 318, 320, 322, 324 and 326 may be formed as recesses in the upper and lower surfaces of the block 300, rather than as through-holes. As will be explained later with reference to the comb-like connector devices used in connecton with this embodiment of interconnected block system, the recesses need only be deep enough to receive the fingers of the connector devices in a frictional fit.

The preferred block 300 also includes a centrally located, stepped through-aperture 328. The lower portion 330 of the aperture 328 has a diameter of approximately 1.5 inches and a height of approximately 2.125 inches. An upper portion 332 of the aperture 328 joins the lower portion by a shoulder 334. The upper portion 332 has a diameter of approximately three inches and height of approximately 1.5 inches.

As illustrated in FIG. 20, the aperture 328 is used for anchoring of a geomattress, shown schematically at 301 as including an underlying matrix 303 to which a plurality of blocks 300 are attached as discussed below; to a slope 311, embankment, or under water for erosion control, or the like. Typically, an anchoring bolt, terminal portions of which are shown in dotted lines at 305, having an engineered earth anchor at the distal end (not shown) is inserted underground. The earth anchor is actuated by a slight upward movement of the anchor bolt so as to activate engagement with the earth by an anchor plate. At the proximal end of the anchor bolt 305, a washer 307 is inserted so as to seat on the shoulder 334 of the aperture 328. A nut 309 is then applied to the threaded proximal end of the anchor rod until the nut is seated within the section 332 of the aperture 328. A portion of the anchor rod projecting above the block 300 may then be removed, if desired, to provide an aesthetically pleasing appearance and to facilitate covering of a plurality of blocks 300 by a grid anchored to the upper surface 302, if desired.

Interconnected block systems comprising the preformed blocks 300 may be used in the same manner as the embodiments described above. The connection of the block 300 to a sheet material matrix, as well as additional uses of the block 300 will be explained with particular reference to FIGS. 21 through 25.

Figure 21:
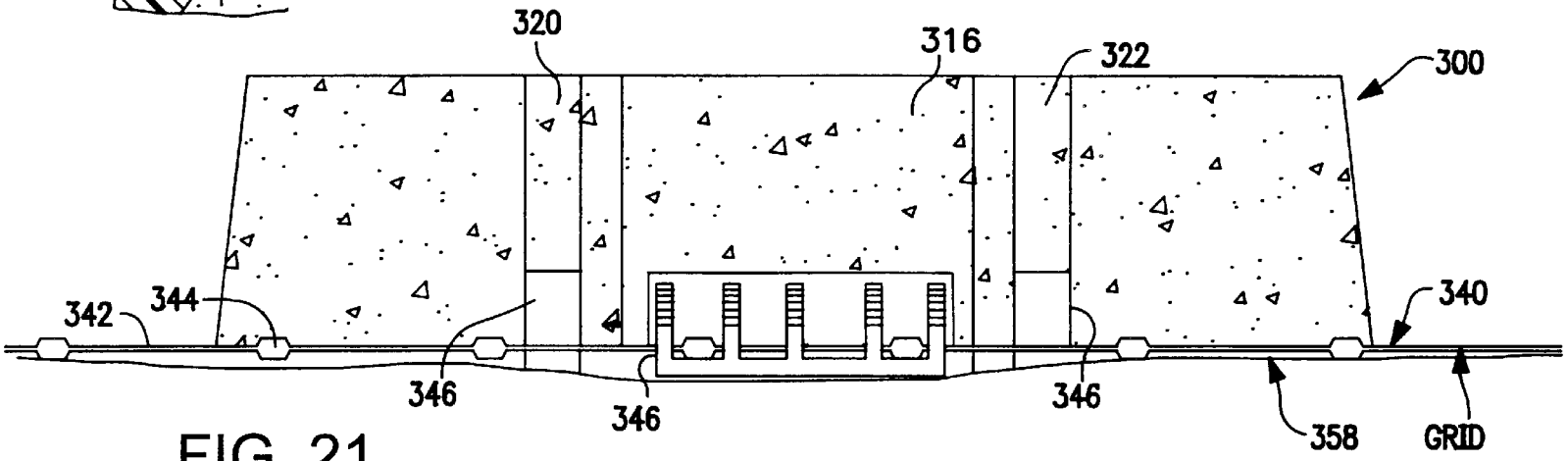
FIG. 21 schematically illustrates the connection of a sheet material matrix to the underside of a concrete block such as shown in FIGS. 18–20 by the use of a plurality of comb-like connector devices engaged within preformed slots extending from the upper surface to the lower surface of the block.

In FIG. 21, a block 300 is shown secured to an underlaying sheet material matrix 340. In the example shown, the matrix is a geogrid having a plurality of strands 342 and nodes 344 which connect the strands 342 to perpendicularly extending strands or bars.

Figure 22:
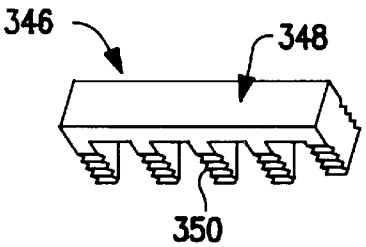
FIG. 22 is a perspective view of a comb-like connector device as used to secure a section of sheet material matrix to the underside of the block shown in FIG. 21.

To secure the grid 340 to the block 300, a plurality of comb-like connector devices 346 are preferably used. With reference to FIG. 22, the connector devices 346 include a crossbar 348 with a plurality of integral spaced fingers 350 projecting therefrom. The fingers 350 preferably include lateral sidewalls 352 which include, proceeding downwardly from crossbar 348, a plurality of spiked projections 354. The projections 354 extend approximately 1/16 of an inch beyond the side walls 352 of the fingers 350. Each spiked projection 354 has an overall height of approximately 3/16 of an inch.

Figure 23:
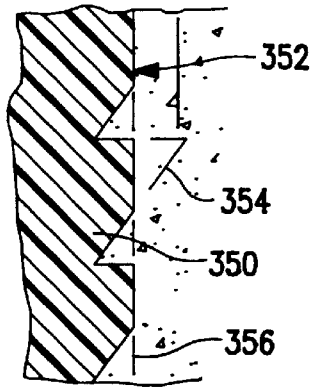
FIG. 23 is an enlarged sectional view of the engagement of the teeth of the fingers of the connector device shown in FIG. 22 in the sidewalls of the slots of the block shown in FIGS. 18 through 21.

In FIG. 23, the spike projection 354 is schematically shown engaging a sidewall 356 of slot 320. Due to the resilient nature of the material of the connector device 346, the spike projections 354 are driven inwardly along the length of the sidewalls 356 of the slots for frictional engagement with the sidewalls. By the angle of inclination of the spike projections 354, it is possible to drive the fingers 350 into the slots whereas considerable force would be required to extricate the connector devices 346 from the slots.

The fingers of the connector devices are spaced a multiple of the spacing between apertures of the grid matrix 340 interconnecting the blocks 300. Only three connector devices 346 are seen in FIG. 21, although it is understood that preferably a connector devices would be located in each of the slots 316, 318, 320 and 322 so as to completely secure the blocks to the grid.

An optional geotextile 358 is shown in FIG. 21 underlying the grid 340 and the crossbar 348 of the connector devices 346 to provide the same advantages as the use of a geocomposite in the previous embodiments. Of course, the connector devices could be driven through the geotextile, if desired.

Figure 24:
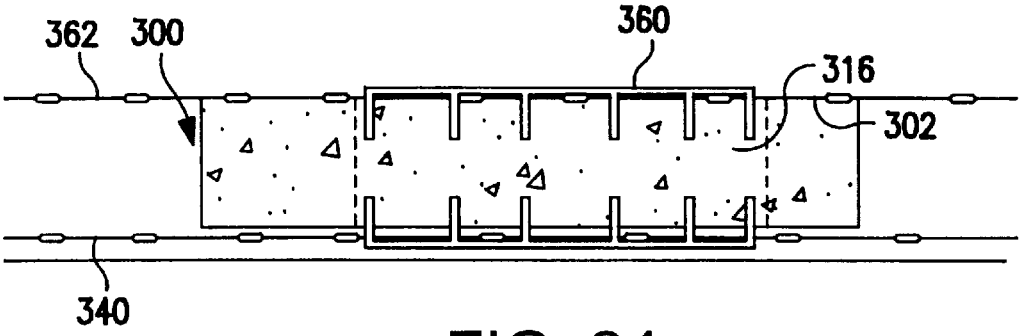
FIG. 24 is a sectional view showing comb-like connector devices engaged in slots in both the lower and upper surfaces of a block for securing sheet material matrices to both surfaces.

In FIG. 24, an optional top grid 362 is secured to the block 300 by additional connector devices, one of which is shown at 360. The use of both underlying and overlying interconnecting grid matrices provides a number of advantages in addition to increasing the strength of the geomattress. For example, in FIG. 28, a plurality of blocks 364, 366, representative of a plurality of rows of blocks secured to a matrix in a geomattress, define gaps or pockets 368 between the blocks and bottom and top layer of interconnecting grid 370, 374, respectively. The pockets 368 may be filled with fiber (mulch) or an aggregate such soil or stone 372. The fill material provides increased erosion resistance by providing an undulating path for water passing over the upper surfaces of the blocks. Additionally, the fill material may provide a growing medium to encourage vegetation to root and further resist erosion.

Figures 27, 28, 29:
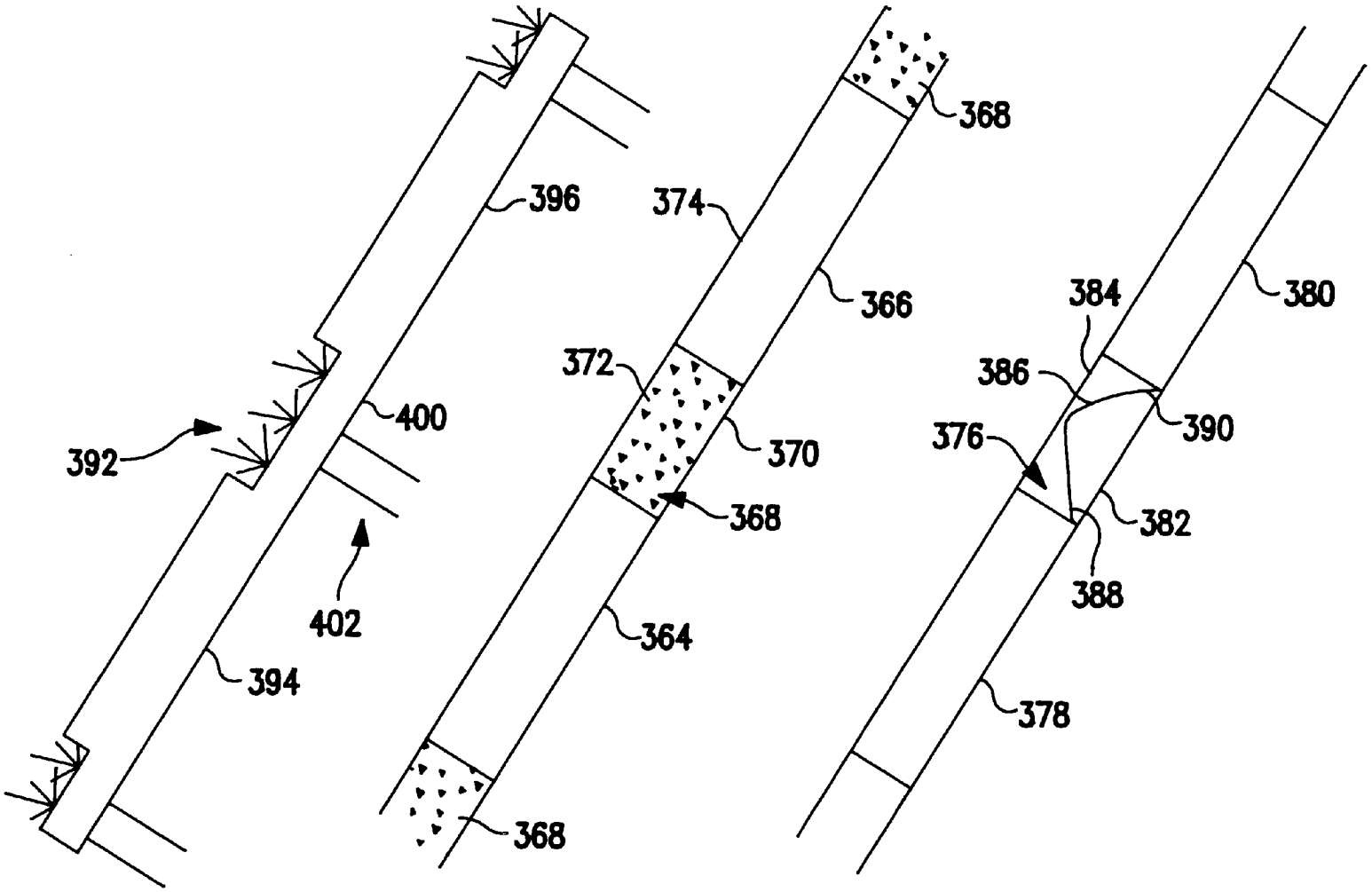
FIG. 27 is a side sectional view illustrating the filling of a gap between adjacent blocks in a geomattress formed according to this invention with, for example, shotcrete, hydroseeded soil or staked sod.
FIG. 28 is a similar view of an interconnected block section according to this invention including upper and lower sheet matrices defining pockets between the blocks which may be filled with fiber, soil or stone fill material.
FIG. 29 is a view similar to FIG. 28 wherein small sections of a drainage net baffle are located in the pockets formed between adjacent blocks and the sheet material matrices to slow runoff and trap sediment passing over the blocks of the geomattress.

In FIG. 29, a gap or pocket 376 is shown between blocks 378 and 380 and the lower upper grids 382, 384. A short section of drainage net 386 or the like is bent along a horizontally extending axis so that its leading edge 388 and trailing edge 390 engage the blocks 378 and 380. The net may be connected to the upper grid 384 by a cable tie to retain its position. The drainage net 386 may be similar to the net material sandwiched between two layers of geofabric in drainage composite DC6205 available from The Tensar Corporation as previously described.

Water passing downwardly over the upper surface of block 380 will be caused to pass through the upper grid 384 and down onto the drainage net 386. This will slow the speed of the runoff water and cause sediment in the water to be trapped by the drainage net 386 in the gap 376. Build up of sediment will foster growth of vegetation and provide additional resistance against erosion.

Although the formation of pockets by upper and lower interconnecting grid matrices enhances the incorporation of erosion-reducing fill material, as illustrated in FIG. 27, gaps 392 between blocks such as shown at 394 and 396 may be filled with shotcrete, hydroseeded soil or staked to improve the effectiveness of a geomattress formed according to this invention even without the upper layer of grid. Earth staples 402 may be used to anchor the fill material 400 in the gap 392, and to anchor the geomattress to an underlying base material.

Figure 30:
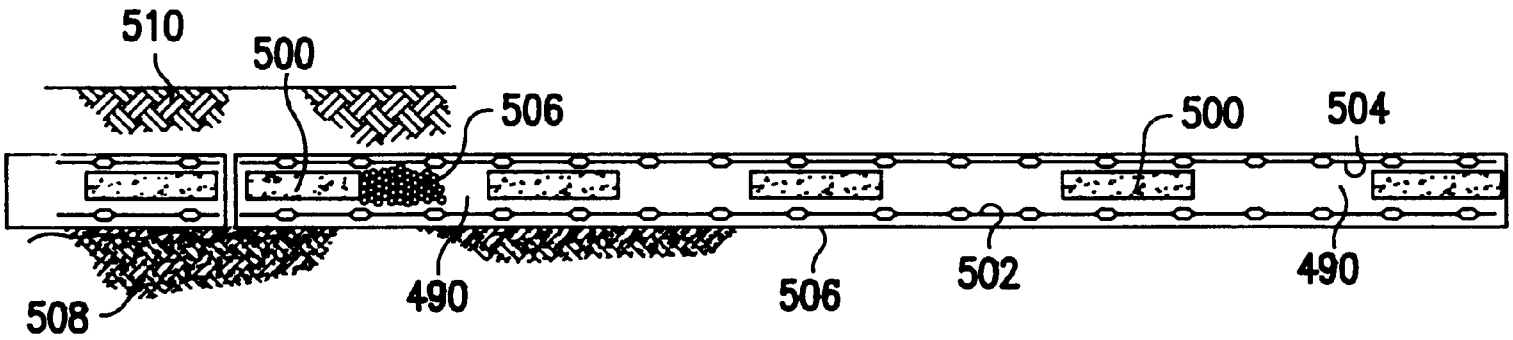
FIG. 30 is a side view of the use of a geomattress as a cap for contaminated sediments wherein sorptive fill material is carried in the pockets and a geotextile wrap is used to capture the sorptive particles, an optional soil cover being illustrated.

In FIG. 30, the pockets 490 between blocks 500 and lower and upper interconnecting grid matrices 502, 504 are filled with a sorptive material 506, either prior to, or after securing the upper layer of geogrid 504 to the blocks. The sorptive fill material may, for example, be activated carbon particles which fill the gaps surrounding the blocks in the geomattress. Since such materials are commonly light weight, of a particle size smaller than the apertures in the grid-like interconnecting matrices, and buoyant, the entire geomattress may be sealed in a geotextile wrap 506 to keep the sorptive material from floating away when the geomattress is used underwater. The geotextile wrap 506 is of an integral form or of pieces which, when assembled, cover the top, bottom, front edge, rear edge and side walls of a formed geomattress.

The thus-formed geomattress may then be used to cap a contaminated sediment bed 508 with an optional cover layer of soil 510. With this arrangement, contaminants escaping from the sediment bed 508 will pass through geotextile located below the blocks 500 to be absorbed or adsorbed by the sorptive fill material 506. The close proximity of the sorptive fill material to the contaminated sediment provides for an effective treatment of contaminant materials as they are released into the surrounding subaqueous environment.

Figure 31:
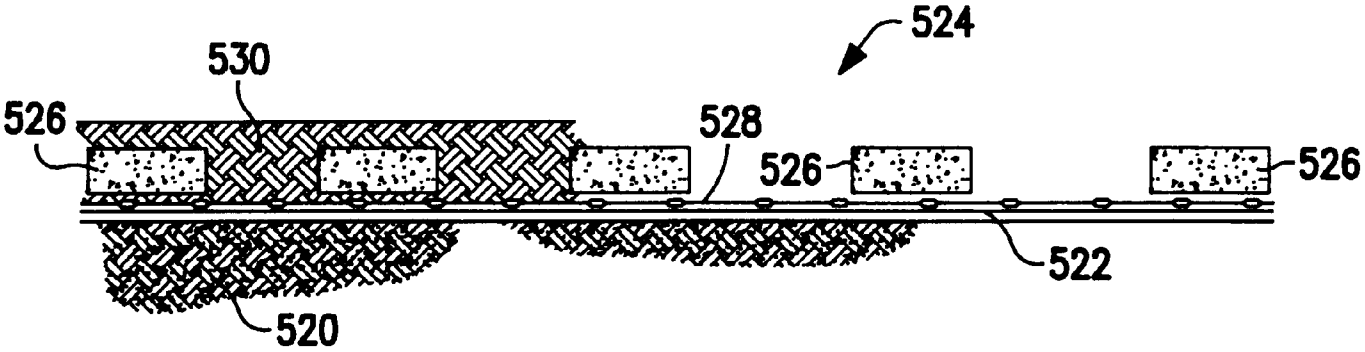
FIG. 31 is a side view of a geomattress cap for contaminated sediments wherein a geotextile matrix is highly sorptive, or a multi-layer geotextile is provided with sorptive particles therebetween.
Figure 32:
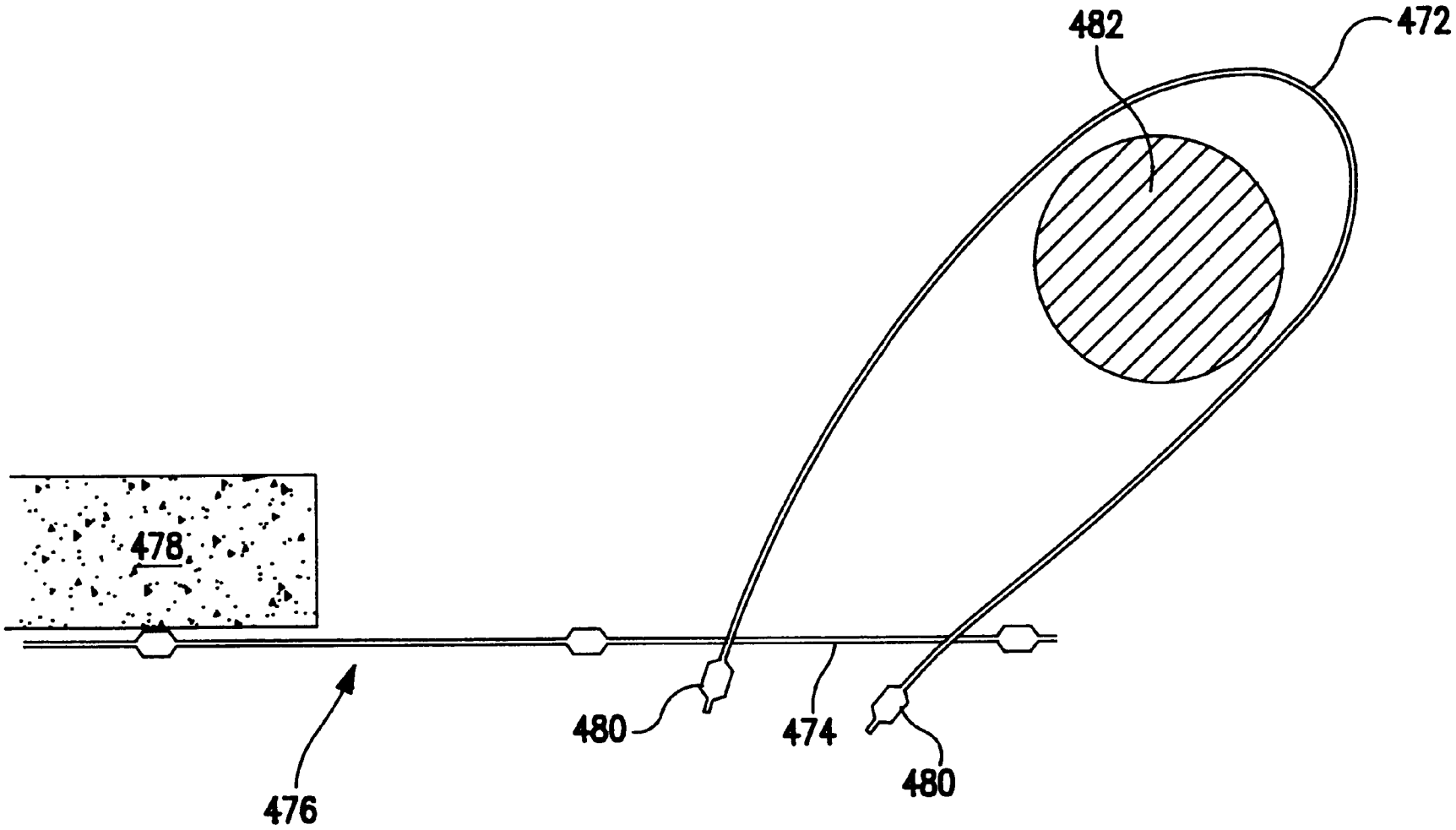
FIG. 32 is a side elevational view of a sling system for lifting a geomattress wherein the strands of one or more sections of uniaxially oriented geogrid sling members are passed between the strands of a geogrid matrix underlying the blocks of a geomattress, with a lifting bar extending between aligned sling members for engagement by heavy equipment such as a crane or the like to lift and place the entire geomattress.

Alternatively, as shown in FIG. 31, a contaminated sediment bed 520 may be covered by a sorptive geotextile layer 522 or a plurality of geotextile layers trapping a sorptive material between them, which is positioned below a geomattress 524 including concrete blocks 526 attached on one side to a geogrid layer 528. Continuous filament, nonwoven, needle-punched geotextile materials are commercially available which have been formulated and/or treated to preferentially absorb or adsorb hydrocarbons and other such contaminants from an aqueous environment and such materials may form the layer 522. An optional soil cover layer 530 covers the geomattress 524 and fills the gap between adjacent blocks 526.

Juxtaposed sections of geomattress may be integrated by a variety of splicing techniques according to this invention. For example, in FIG. 25, two separate geomattress sections 404 and 406 are aligned adjacent to each other. The terminal edge portions 408 of grid matrix 410 of the section 404 underlies overlapping terminal edge portions 412 of grid matrix 414 of section 406. Optionally, edge portions of geotextile 416 associated with grid 410 may be positioned to underlie edge portions of geotextile 418 associated with grid 414.

As with the previous embodiments, connector 420 secure the grid 410 to the lower surface of block 422 and connectors 424 secures grid 414 to the lower surface of block 426. In addition, in this embodiment, the gap 428 formed between the blocks 422 and 426 may be filled with fill material as in FIGS. 28 and 29. To assist in securing the fill material in place, and to interconnect the sections 404, 406, an elongated splicing strip 430 of grid material extends across the gap and over the upper surfaces of the blocks 422, 426. To secure the splicing strip 430 in place a plurality of connectors 432 having spaced apart fingers 434, extend between the openings of the grid and into, at each end, one of the optional slots 324 and 326 provided in the preformed blocks as shown in FIG. 18.

Figure 26:
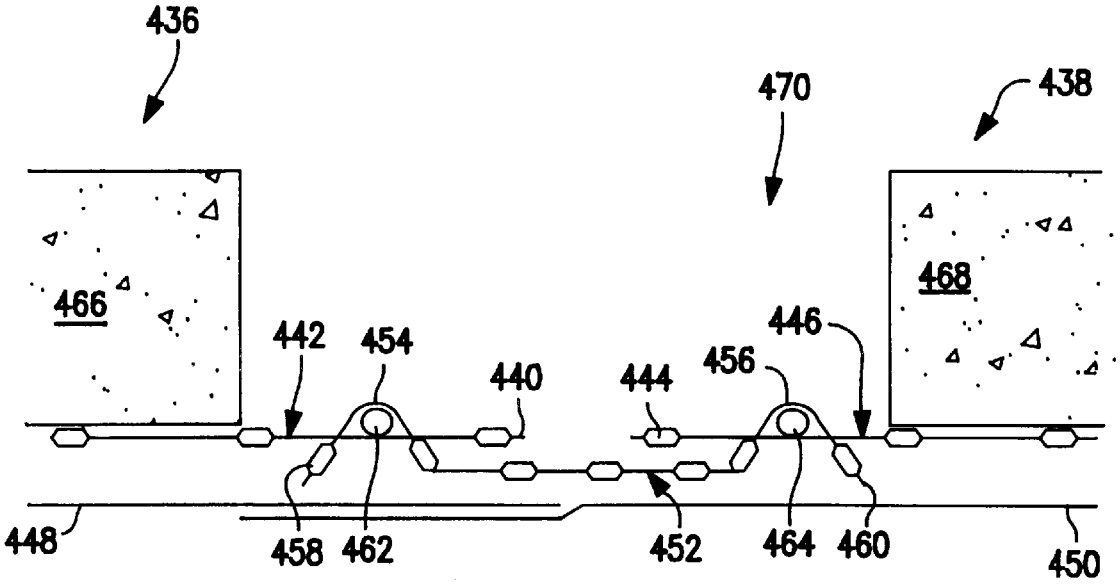
FIG. 26 is a side view of juxtaposed edge portions of two sections of geomattress with the underlying matrices of the two sections interconnected by a splice plate secured to each edge portion by a bodkin joint.

Another system for connecting adjacent geomattress sections 436, 438, is shown in FIG. 26. In this embodiment, terminal end portions 440 of grid section 442 carrying blocks such as shown at 466 are juxtaposed to terminal end portions 444 of grid section 446 carrying blocks 468. Optional underlying layers of geotextile 448, 450, may be present as in previous embodiments. The terminal end portions 440, 444 of the grids 442, 446, respectively are joined by a grid splice plate 452. The strands of the end portions 454, 456 of the splice plate 452 adjacent the ends portions 440, 444, respectively, of the grids 442, 446 are bent so that they project between the strands of the grid as is known in the formation of a bodkin joint. Connection rods 462, 464 are inserted between interleaved portions of grid material to preclude retraction of these portions. A joint between the adjacent geomattress sections 436, 438 is thereby formed.

Figure 25:
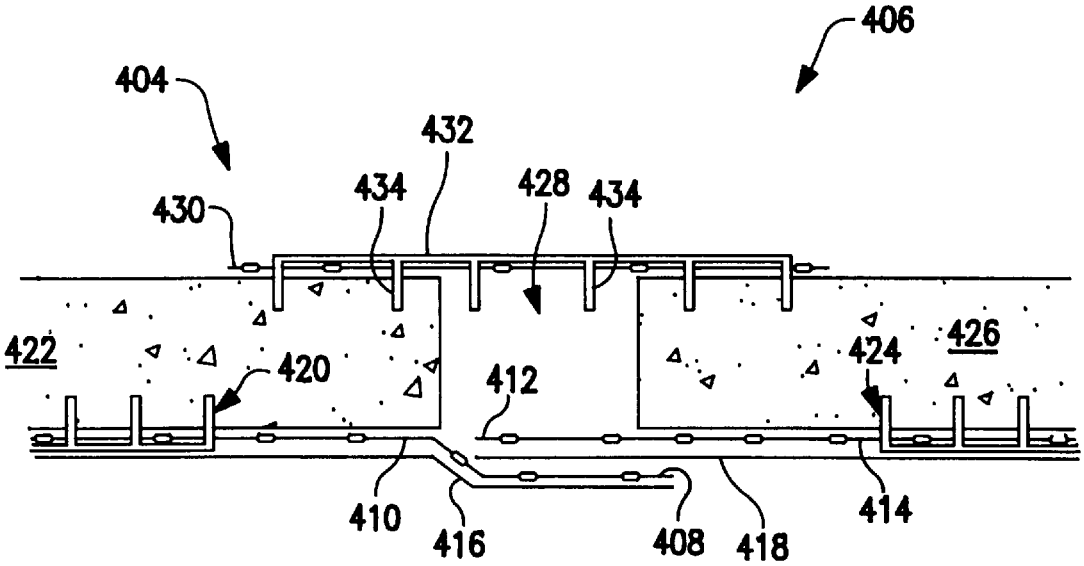
FIG. 25 is a side sectional view illustrating the use of comb-like connector devices to secure underlying matrix sheets to blocks of a pair of geomattresses with an additional comb-like connector devices bridging a gap between adjacent geomattresses sections and securing a length of sheet material to slots in blocks in each of the geomattress sections.

As discussed with respect to FIG. 25, an overlying splicing strip may also be secured between the blocks 466 and 468 to close the gap 470 between the geomattress sections 436 and 438, if desired.

As an example of one way in which an individual interconnected block system according to this invention or an enlarged system formed from a plurality of attached sections of geomattresses, may be lifted, as illustrated in FIG. 30, a lifting hoop 472 may be formed by bending a section of, preferably, uniaxially oriented integral geogrid, such that its strands pass between the strands of a terminal portion 474 of a length of geogrid 476 extending laterally from blocks 478 located at the edge of the geomattress to be lifted. The bars 480 at the ends of the lifting hoop 472 are restrained by the strands of the section 474 of the grid 476. Accordingly, when a lifting bar 482 is threaded through a plurality of lifting hoops spaced along the terminal portions 474 of a geomattress, the entire mattress can be lifted by the bar 482. Due to the uniaxial orientation of the strands of the lifting hoop 472, the weight of a single or a plurality of sections of a geomattress may be lifted by the capturing of the lifting bar 482 within the strands of the lifting hoop 472.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. An interconnected block system for use as a geomattress in erosion control comprising at least one sheet of matrix material having a first surface and a second surface, a plurality of block members secured to said first surface of said matrix sheet in a predetermined pattern of a single layer, each block member in said predetermined pattern being spaced from at least one other block member in each of two mutually perpendicular directions parallel to said first surface of said matrix sheet to define gaps between juxtaposed block members in each of said two mutually perpendicular directions, said block members each having opposite surfaces, at least one recess in at least one surface of said block members, and at least one connector element for securing each block member to said first surface of said matrix sheet, each connector element including a base portion juxtaposed to said second surface of said matrix sheet, a plurality of projections carried by said base member and passing through said matrix sheet, said projections including portions extending beyond said first surface of said matrix sheet to mechanically anchor said block members on said matrix sheet by frictional engagement within said at least one recess.

2. The block system of claim 1, wherein said block members are formed of concrete.

3. The block system of claim 2, wherein said grid-like sheet comprises interconnected strands.

4. The block system of claim 3, wherein said grid-like sheet is an integral structural geogrid.

5. The block system of claim 4, wherein said geogrid is uniaxially oriented.

6. The block system of claim 4, wherein said geogrid is biaxially oriented.

7. The block system of claim 2, wherein said matrix material comprises a geocomposite including a geotextile and said grid-like sheet.

8. A method of forming an interconnected block system for use as a geomattress in erosion control, said method comprising:

providing at least one sheet of matrix material having a first surface and a second surface, providing a plurality of connector elements each including a base portion having a plurality of projections extending therefrom, said projections including free end portions configured to be mechanically anchored in said block members, positioning each connector element with respect to said matrix sheet such that said base portion is juxtaposed to said second surface of said matrix sheet and said free end portions of said projections project through said matrix sheet and extend beyond said first surface of said matrix sheet, and providing a plurality of block members each of which has a recess in at least one surface thereof, positioning said block members in a predetermined pattern wherein each block member is spaced from at least one other block member in each of two mutually perpendicular directions parallel to said first surface of said matrix sheet, and driving said free end portions of said projections of at least one of said connector elements into frictional engagement in the recess of each said block member to secure said plurality of said block members to said first surface of said matrix sheet in a spaced apart pattern of block members having gaps between juxtaposed block members in each of said two mutually perpendicular directions.

9. A method as claimed in claim 8, wherein said matrix sheet includes an integral structural polymer geogrid.

10. A geomattress construction for control of erosion in an underlying surface, said geomattress construction including at least one sheet of matrix material, a plurality of block members secured to said matrix sheet in spaced relationship to each other, anchoring bolts for securing said geomattress to the underlying surface, each of said block member members comprising:

a first surface and a second surface joined by opposed sidewalls, a front wall and a rear wall, a plurality of recesses defined in said first surface and in said second surface, and an aperture extending between said first surface and said second surface, said aperture including two portions separated by a shoulder, a terminal portion of an anchoring bolt extending through said first portion of said aperture into said second portion in at least selected blocks, the remainder of said anchoring bolt extending into the underlying surface, and a nut secured on said terminal portion seated within said second portion of said aperture adjacent said shoulder to secure said geomattress to the underlying surface.

11. A geomattress construction as claimed in claim 10, which said recesses extend perpendicular to each other.

12. A geomattress construction as claimed in claim 10, wherein said recesses extend parallel to each other.

13. A geomattress construction as claimed in claim 10, wherein some of said recesses extend perpendicular to each other and some of said recesses extend parallel to each other.

14. A geomattress construction as claimed in claim 10, wherein said recesses in said first surface and said lower surface form slots extending between said first surface and said second surface.

15. A geomattress construction as claimed in claim 10, wherein said aperture is cylindrical in shape.

16. An interconnected block system comprising:

a plurality of block members, each of said block members including opposite surfaces, elongated slots being defined in each of said opposite surfaces, two sheets of matrix material secured to said opposite surfaces of said plurality of block members, said matrix material comprising a sheet of grid-like material comprising interconnected strands defining a plurality of apertures, and connector elements extending through said matrix material and into said block members from opposite directions to secure said block members to said two sheets of matrix material, said connector elements each including an elongated crosspiece, a plurality of fingers extending from said crosspiece, said fingers extending through said apertures of said matrix sheet and being frictionally engaged in said slots in said block members.

17. An interconnected block as claimed in claim 16, wherein said connector elements each include a plurality of fingers frictionally engaged in a slot in said block member.

18. An interconnected block as claimed in claim 17, wherein said matrix material comprises a sheet of grid-like material comprising interconnected strands defining a plurality of apertures.

19. An interconnected block as claimed in claim 16, wherein said fingers are connected together by a crosspiece.

20. An interconnected block as claimed in claim 16, wherein said grid-like material is an integral structural geogrid.

21. An interconnected block as claimed in claim 16, wherein said block members are spaced apart to form a gap between adjacent block members.

22. An interconnected block system comprising:

a plurality of block members, each of said block members including opposite surfaces, two sheets of matrix material secured to said opposite surfaces of said plurality of block members, and connector elements extending through said matrix material and into said block members from opposite directions to secure said block members to said two sheets of matrix material, said block members being spaced apart to form a gap between adjacent block members, said gap being filled with fill material.

23. An interconnected block system comprising:

a plurality of block members, each of said block members including opposite surfaces, two sheets of matrix material secured to said opposite surfaces of said plurality of block members, and connector elements extending through said matrix material and into said block members from opposite directions to secure said block members to said two sheets of matrix material, said block members being spaced apart to form a gap between adjacent lock members, said gap including a bent matrix material secured at its bend to one of said two sheets of matrix material.

24. A plurality of interconnected block systems, each interconnected block system including a plurality of block members secured to a matrix material including block members located at an edge of said matrix material, a connector element interconnecting the block members at the edges of adjacent matrices in adjacent interconnected block systems, further including a splicing strip of matrix material extending across each said gap and said connector element securing said splicing strip to said block members at said edges of adjacent interconnected block members.

25. A plurality of interconnected block systems as claimed in claim 24, wherein said matrix material comprises a sheet of grid-like material comprising interconnected strands defining a plurality of apertures.

26. A plurality of interconnected block systems as claimed in claim 24, wherein said grid-like material is an integral structural geogrid.

27. A plurality of interconnected block systems with each interconnected block system including a plurality of block members secured to a matrix material, a splice plate interconnecting an edge of said matrix material of one interconnected block system to an edge of matrix material of another interconnected block system, said splice plate having opposite ends secured to said edge of said matrix material of said interconnected block system and to said edge of said matrix material of said another interconnected block system, respectively.

28. A plurality of interconnected block systems as claimed in claim 27, wherein said splice plate comprises a sheet of grid-like material comprising interconnected strands defining a plurality of apertures.

29. A plurality of interconnected block systems as claimed in claim 27, wherein two connection rods secure said splice plate to said matrix material of said one and said matrix material of said another interconnected block system.

30. An assembly for lifting an interconnected block system, said assembly comprising:

a plurality of sections of matrix material for forming lifting hoops by passage through a matrix material of an interconnected block system, and a lifting bar for passing through a space formed between said plurality of sections of matrix material and said matrix material of said interconnected block system.

31. An interconnected block system comprising:

a plurality of block members secured to a matrix material sheet, a plurality of sections of matrix material forming lifting hoops by passage through said matrix material sheet to which said block members are secured, and a lifting bar passing through a space formed between said plurality of sections of matrix material and said matrix material to which said block members are secured.

32. A geomattress for capping a subaqueous deposit of contaminated sediments, said geomattress comprising:

a sheet of matrix material, a plurality of block members secured to said sheet of matrix material in a staggered pattern forming gaps between adjacent blocks, sorptive material located in said gaps, and geotextile wrapped around said sheet of matrix material and said plurality of block members so that when the geomattress is on top of the contaminated sediments the contaminated sediments pass through the geomattress and encounter said sorptive material for reduction of escape of contaminated sediments from a subaqueous environment.

33. A system for capping a subaqueous deposit of contaminated sediments, said system comprising:

a geomattress including a sheet of matrix material and a plurality of block members secured to said sheet of matrix material, at least one layer of geotextile to be placed between said geomattress and the contaminated sediments, said at least one layer of geotextile including sorptive material for reacting with the contaminated sediments so as to reduce escape of contaminated sediments to the surrounding subaqueous environment.

* * * * *